United States Patent [19]

Deliege et al.

[11] 4,147,390

[45] Apr. 3, 1979

[54] NODULE DREDGING APPARATUS AND PROCESS

[75] Inventors: Jacques Deliege; Michel Giot; Vsevolod Obolensky, all of Brussels; Luc Deconinck, Ieper; Marc Lejeune, Ottignies-Louvain-la-Neuve, all of Belgium

[73] Assignee: Union Miniere S.A., Brussels, Belgium

[21] Appl. No.: 873,744

[22] Filed: Jan. 30, 1978

Related U.S. Application Data

[63] Continuation-in-part of Ser. No. 808,838, Jun. 22, 1977, abandoned, which is a continuation of Ser. No. 712,115, Aug. 5, 1976, abandoned.

[30] Foreign Application Priority Data

Aug. 6, 1975 [LU] Luxembourg ..... 73155

[51] Int. Cl.[2] ..... E02F 3/94

[52] U.S. Cl. ..... 299/8; 37/DIG. 8

[58] Field of Search ..... 299/8; 37/DIG. 8

[56] References Cited

U.S. PATENT DOCUMENTS

| | | | |
|---|---|---|---|
| 3,226,854 | 1/1966 | Mero | 37/58 |
| 3,248,812 | 3/1966 | Gardner | 37/61 |
| 3,310,894 | 3/1967 | Ball | 37/61 |
| 3,802,740 | 4/1974 | Sullivan | 299/8 |
| 3,973,575 | 5/1976 | Sullivan et al. | 37/DIG. 8 X |
| 3,975,054 | 5/1976 | Brockett et al. | 299/8 |
| 3,988,843 | 11/1976 | Brockett | 37/DIG. 8 X |
| 4,042,279 | 8/1977 | Asakawa | 299/8 |
| 4,070,061 | 1/1978 | Obolensky | 299/8 |

FOREIGN PATENT DOCUMENTS

| | | |
|---|---|---|
| 2555490 | 6/1976 | Fed. Rep. of Germany. |
| 2211587 | 7/1974 | France. |
| 1156547 | 6/1969 | United Kingdom. |
| 1207906 | 10/1970 | United Kingdom. |

OTHER PUBLICATIONS

"Mining and Transport of Manganese Nodules–Technical Problems", Riedal, 1975, pp. 27–29.

*Primary Examiner*—Ernest R. Purser

*Attorney, Agent, or Firm*—Pollock, Vande Sande & Priddy

[57] ABSTRACT

Nodule dredge comprising one or more of the following: convergent wall device, e.g., "horn member", for accelerating liquid flow through the apparatus; comb or grid-like collecting or lifting device that can lift nodules into accelerated flow without necessarily lifting an entire layer of silt, especially where silt is relatively loose; inclined surface to receive and raise nodules driven down stream by accelerated flow, while silt is removed; and collection chamber below nodule path defined by inclined surface, to receive nodules from inclined surface. Process comprising one or more of the following: accelerating a flow of water with a convergent wall device; mechanically lifting nodules into the accelerated flow; driving the nodules up an inclined surface and cleaning them, using the accelerated flow, while establishing the flow in a direction which will project water and dispersed silt upwardly and rearwardly downstream of the inclined surface; and introducing the nodules into a collection chamber having an entrance turned away from said direction of flow.

61 Claims, 12 Drawing Figures

NODULE DREDGING APPARATUS AND PROCESS

CROSS REFERENCE TO RELATED APPLICATIONS

This application is a continuation in part of U.S. patent application Ser. No. 808,838, filed June 22, 1977, and now abandoned which is a continuation of U.S. patent application Ser. No. 712,115, filed Aug. 5, 1976 and now abandoned, the disclosures of which applications are hereby incorporated by reference.

BACKGROUND

The sea bed includes surface layers of sedimentary material, exhibiting varying degrees of looseness or consolidation, which are composed of small particles of said, silt, and clay in, on and among which may be dispersed small particles of rock and metallic nodules. For the sake of convenience, the term "silt" is used in this disclosure and accompanying claims to refer to all such sedimentary material other than the nodules, including sand, clay, silt or small rock particles, or a combination thereof, irrespective of whether the sedimentary material is of a loose or agglutinated character.

Since at least the early 1960's it has been considered that literally billions of tons of such valuable metals as manganese, nickel, copper, and cobalt lie associated with such silt layers. Many of the nodules are believed to lie on the surface of the silt. Others are believed to lie partially or completely buried near the silt surface.

The presence of these nodules generated keen interest in development of dredging equipment for collecting them and raising them to the surface. However, the bulk of the proposals which have been published to date involve one or more disadvantages. These include one or more of the following: pressing the surface nodules and only partially buried nodules into the silt before collecting same, scooping up all of the material in the silt layer to a given depth even though only a portion of the layer is desired material, excessive resistance to transport over the sea bed, preferentially collecting the smallest nodules, choking up with oversize material, inadequate removal of silt from the nodules prior to lifting same to the surface, requirement of a separate unit for cleaning the nodules prior to such lifting, the energy consumption and maintenace costs and delays connected with the use of powerful electric motors and turboshaft engines in the hostile, inaccessible environment where the dredge operates. Thus, a need remains for improved apparatus and processes which avoid some or all of the foregoing disadvantages.

SUMMARY OF THE INVENTION

This invention in its varying embodiments, represents a partial or complete solution to foregoing need. The invention includes both apparatus and process aspects.

According to one of the apparatus aspects the invention may be defined as apparatus adapted to be transported along the surface of the sea bed for gathering nodules therefrom, and includes water acceleration means. The latter comprises an inlet with wall means extending rearwardly of said inlet to define a channel which has its bottom open to and adjacent the sea bed; that is, the wall means includes bottom edges which lie close to or engage the sea bed for inhibiting outward and sideward escape of water accelerated in said channel. Said wall means converge rearwardly of said inlet to provide progressively reduced cross-sections in the channel for generating therein a generally horizontal and longitudinal progressively accelerating flow of water whose velocity substantially exceeds the rate of transport of the apparatus over the sea bed. The inlet and cross-sections are all sufficiently large to accept nodules of desired size.

The device also includes mechanical lifting means, disposed rearwardly of said acceleration means inlet, and extending transversely of the above-mentioned flow across the lower portion of the channel. The lifting means includes for example, at least one array of laterally spaced upwardly and rearwardly inclined elongated members sufficiently close together to raise nodules of minimum desired size from the sea bed and to direct the nodules upwardly to a predetermined elevation. The lifting means are moveable between a normal stationary working position and recoiled position for obstacle clearance.

The apparatus preferably includes duct means having an entry connected with said acceleration means to receive the accelerated flow. The duct means includes confining means extending downstream of said lifting means for defining a path along which nodules received from the lifting means are transported through the duct means. The confining means extends generally longitudinally above, below and to each side of said path. The lower surface of the duct means includes an inclined surface, having a generally horizontal transverse leading edge and extending upwardly and rearwardly relative to said leading edge for elevating a stream of water, nodules and any accompanying silt flowing rearwardly in the duct means. The duct means also includes an outlet, and silt discharge means extend through the inclined surface between the entry and outlet of the duct means. Such discharge means comprise openings for discharging silt.

The apparatus also includes a collection chamber having an entrance at or beyond the downstream end of the inclined surface. It is positioned below the path described in connection with the duct means to receive nodules from said path. The bottom of the collection chamber is below the downstream end of the inclined surface.

There are certain optional but preferred additional characteristics and/or special forms of each of the above features of the invention, which constitute additional improvements or inventions. For instance, although the water acceleration means may take a wide variety of forms consistent with the above description, the wall means thereof may include an upper wall and side walls, and the upper wall may converge with the sea bed, or toward the bottom of the apparatus. Moreover, the side walls may be parallel or non-parallel with one another, but parallel side walls are preferred. According to a different embodiment, the wall means is curved when viewed in transverse cross-section. It is considered desireable that the inlet and cross-sections of the acceleration means be sufficiently large to accept both nodules of desired size and at least a portion of any oversize material encountered by the apparatus. When the rate of transport of the apparatus over the sea bed is sufficient and when the inlet and cross-sections are sufficiently reduced, so as to drive nodules all the way to said collection chamber, the device functions in what is referred to as an hydrodynamic mode, without motor driven propellors or pump-driven water jets to transport and wash the nodules. It is an advantage of the invention that the above-mentioned water acceleration means can be the sole means in said apparatus for accelerating the flow of water and nodules. It is also an advantage of the invention that the apparatus can operate without any grating, screen or the like device across the inlet of the acceleration means, although the use of such devices is not excluded in all cases.

Certain optional characteristics and forms of the mechanical lifting means constitute additional improvements. For instance, it is beneficial if the mechanical lifting means is in the region of maximum convergence of said wall means. The desired lifting action is provided at least in part by mechanical lifting means having a lifting motion for lifting the nodules, as the device moves over the sea bed. However, it is an advantage of preferred embodiments of the invention that they do not require that the nodules be lifted and propelled through the apparatus by motor-powered machinery and other moving parts. Thus, it is preferred to use mechanical lifting means which are normally stationary, the latter including for example, lifting means which develop their lifting action from the motion of the device over the sea bed while occupying a normally stationary working position in the apparatus, and which are moveable between said working position and a temporary recoiled position for obstacle clearance.

The preferred lifting means includes openings which may effect preliminary separation of nodules and silt, such as an inclined apertured plate, grating, grid or comb in which the openings are small enough to prevent nodules of desired size from passing through them. This effect can be particularly pronounced in the case of loose silt. The particularly preferred mechanical lifting means includes at least one array of laterally spaced upwardly and rearwardly inclined elongated members sufficiently close together to lift nodules of minimum desired size. These elongated members may be of any cross-section, but are preferably rounded.

The elongated members may assume various forms and may include fore-and hind-portions, wherein the fore-portions are disposed at a greater angle of inclination with the sea bed than the hind-portions. If the elongated members have lower ends for engaging the sea bed, then a portion of said ends, in an alternating pattern, may extend futher downwardly into the sea bed than the remaining ends.

It is preferred that the upward and rearward inclination of portions of the elongated members of the lifting means be at an angle of elevation in the range of about 35 to about 60° relative to the sea bed. More preferably the angle is about 40 to about 60°, with about 50° to 55° being most preferred. This angle of inclination is applicable to at least the ground engaging portions of the elongated members. More preferably, this angle of inclination also applies to at least a portion of the length of the elongated members which extends above the sea bed. This relatively steep angle facilitates breaking and commencing the dispersion of a portion of the silt while it and the nodules are in contact with the lifting means. While the aforesaid angle may be applicable to the entire length of the elongated members, a portion of their lengths may not be inclined at all or may have a different angle of inclination than that stated. For example, as in the preferred embodiment described above, the elongated members may be divided into a fore portion having an inclination in the above range and a hind portion which is horizontal or has a smaller upward and rearward inclination, such as for example about 20°.

The mechanical lifting means which are moveable between a normal stationary working position and recoiled position may usefully include a plurality of individually moveable arrays of the aforementioned elongated members. Such lifting means may also be supported on transverse shaft means for movement between said normal and recoil positions. If mounted on such a shaft means, the mechanical lifting means may be mounted directly on the shaft means and be connected with members which extend forwardly of said arrays for contacting obstacles and causing rotation to said recoiled position, or may be mounted on lever means suspended from said shaft means for swinging from said normal position to said recoiled position. Such lever means may be spring-biased toward the working position.

Useful information on the operation of the lifting means may be obtained by means of a load device for sensing the load on the lifting means. Thus, load measuring means may be interconnected with the mechanical lifting means in any desired manner. Means may also be provided for adjusting the elevation of said lifting means, and the adjusting means may function in response to the load measuring means.

The leading edge of the inclined surface is at or below the elevation of the rear of the lifting means. Preferably it is positioned at an elevation such that it rides at or above the level of the sea bed.

The positions of the lifting device and the inclined surface may be such that there is or is not a transverse gap between them over which the nodules must pass to reach the inclined surface. It is preferred that this gap, if such exists, should be sufficiently small and/or so positioned that nodules of the desired size are not likely to drop through it. Alternately, the gap, if such exists, may be bridged over completely or at least partially, such as by laterally-spaced elongated bridging members extending between the lifting means and inclined surface and arranged sufficiently close together so that nodules of desired size are not likely to drop through. As the lifting means is moveable, as above described, the bridging members may be flexible or even elastic, thus facilitating relative movement of the lifting means and inclined surface, not withstanding the fact that the bridging means may be connected to one or both of them.

It is beneficial if the inclined surface is inclined in an appropriate manner for establishing the flow of at least a portion of the water introduced into the duct means and any silt which may be dispersed therein in a direction which will project upwardly and rearwardly as said flow passes beyond the downstream end of the inclined surface. Although the silt discharge means may include openings in parts of the duct means other than said inclined surface, the silt discharge means preferably includes an apertured portion of said inclined surface. Thus, a portion of said flow may and usually will pass through the silt discharge openings in the inclined surface. It is preferred that the duct means outlet be of substantially equal or large cross-section than the entry of the duct.

The above-mentioned inclined surface is normally stationary, which includes those desireable embodiments in which it is moveable between a normal stationary working position and a recoiled position for obstacle clearance. Moveable mounting can be provided by suspending the inclined surface from overhead pivots by fore-and-aft swinging lever means.

The collection chamber is positioned at the downstream end of the duct means; more preferably its entrance is immediately adjacent the downstream end of the inclined surface. It is believed there will be less clogging and/or less interference with the generation of flow through the duct means if the collection chamber is entirely below an imaginary rearward projection of the inclined surface. The relatively small amount of silt which reaches the downstream end of the inclined surface will be less likely to gain admission to the collection chamber if its entrance is turned away from the direction of flow of water established by the duct means. Thus, it is particularly preferred that said entrance face upwardly and rearwardly. According to a particularly preferred embodiment, the collection chamber is an open top hopper having upper edges at its front and rear which are below the elevation of the downstream end of said inclined surface. The collection chamber may also be provided with a grate or screen to prevent entry of oversized materials.

In another preferred embodiment, the inclined surface is inclined upwardly for establishing the flow of water and any silt which may be dispersed therein in a direction which will project upwardly and rearwardly as it passes beyond the downstream end of the inclined surface, the collection chamber entrance faces upwardly and rearwardly, and the collection chamber is covered with a screen or grate to prevent entry of oversize materials, which screen or grate extends rearwardly and downwardly while diverging from the direction of flow established by said inclined surface.

According to another preferred aspect, the duct means and collection chamber are arranged to provide a zone above the collection chamber in which the cross-sectional area available for the flow of water and nodules (measured generally perpendicular to the longitudinal flow axis) substantially exceeds that available in the duct means at the downstream end of the inclined surface. Such a zone facilitates gravity release of nodules from the above-mentioned stream into the collection chamber, by slowing the flow. If the duct means does not extend beyond the said downstream end, the said zone may comprise for example the surrounding body of water or possibly only the interior volume of a housing which contains the duct means and collection chamber. On the other hand, if the duct means does not extend over or beyond the collection chamber, said zone may be inclined in the duct means. For example, the side confining means of the duct means may include longitudinal walls which extend beyond the rear end of the collection chamber. These longitudinal walls, the confining means above the nodule path and the collection chamber may then be arranged to provide said zone.

In most instances, the apparatus will include a suction pipe, for removal of nodules, having its inlet in the collection chamber. It is beneficial if the inlet of the suction pipe is turned away from the collection chamber entrance. A tendency towards clogging of this inlet can be reduced by chamfering the suction pipe inlet. Any tendency for this inlet pipe to draw silt into the collection chamber will be reduced if the collection chamber has at least one water inlet other than said entrance.

The process aspect of the invention includes providing apparatus having water acceleration means. The latter comprises an inlet with wall means extending rearwardly of the inlet to define a channel having its bottom open to and adjacent the sea bed. Said wall means converge rearwardly of the inlet to provide progressively reduced cross-sections in the channel, said inlet and cross-sections all being sufficiently large to accept nodules of desired size. The process includes the step of transporting said acceleration means along the surface of the sea bed for generating therein a generally horizontal and lognitudinal progressively accelerating flow of water whose velocity exceeds the rate of transport of said apparatus over the sea bed.

Simultaneously, using lifting means comprising at least one array of laterally spaced upwardly and rearwardly inclined elongated members which are sufficiently close together to raise nodules of desired size from the sea bed, and which are moveable between a normal stationary working position and a recoiled position for obstacle clearance, nodules are lifted from the sea bed. More specifically, in a region downstream of the acceleration means inlet and extending transversely of the aforementioned flow across the lower portion of said channel, the nodules are raised to a predetermined elevation and introduced into said flow.

The aforementioned flow, nodules and at least a portion of any silt that may be associated with said nodules are introduced into duct means. The latter includes an entry connected with the acceleration means, confining means extending downstream of the lifting means for defining a path for nodules received from the lifting means, and an outlet. The confining means extends generally longitudinally above, below and to each side of said path. An inclined lower surface of said duct means has a generally horizontal transverse leading edge and extends upwardly and rearwardly relative to said leading edge. Silt discharge means comprising openings extend through the confining means between said entry and outlet.

The said flow is continued along the duct means while discharging from the duct, through said openings, any silt dislodged from said nodules during said flow. Moreover, the flow of water and any silt which may be dispersed therein are established in a direction which will project upwardly and rearwardly downstream of said inclined surface. The nodules are introduced into a collection chamber having an entrance turned away from said direction of flow. Also, the nodules are driven all the way from the lifting means to the collection chamber with the accelerated flow of water generated by the motion of the apparatus through the water.

The above process features may also have optional forms and/or characteristics constituting additonal improvements or inventions. For instance, the inlet and cross-sections of the water acceleration means are preferably sufficiently large to accept both nodules of desired size and at least a portion of any oversize materials encountered by the apparatus. The most efficient entrainment of nodules may be achieved if they are lifted from the sea bed in or adjacent the region of maximum convergence, i.e. minimum cross-sectional area, of the wall means.

Gravity release of nodules from the above-mentioned stream into the collection chamber is facilitated by providing a zone above the collection chamber which is of larger cross-sectional area than that of the duct means at the downstream end of the inclined surface, measured generally perpendicular to the direction of flow. Preferably the process includes the step of preventing oversize materials from entering said collection chamber. In a particularly preferred embodiment, the collection chamber entrance faces upwardly and rearwardly and said collection chamber is covered with a screen or grate which extends rearwardly and downwardly while diverging from the direction of flow established by said inclined surface, and the process includes the steps of preventing over-sized materials from entering said collection chamber using said screen or grate, and causing said over-sized materials to drop from the rear of the screen or grate.

The particularly preferred procedure for removing nodules from the collection chamber is to remove them through a suction pipe having its inlet in the collection chamber. When doing this, it is beneficial to admit water to the collection chamber through at least one water inlet other than the entrance to said collection chamber.

Additional driving force for entraining and driving nodules up the inclined surface toward the collection zone may be generated by discharging the flow of water from the duct means to the surrounding sea water through an outlet which is of larger cross-section as compared to the cross-section of the duct at its entry, measured generally perpendicular to the direction of flow.

The foregoing improvements, and others, are illustrated by three specific embodiments of the invention, given by way of example and not limitation, and described in the accompanying drawings and related text.

IN THE DRAWINGS

GENERAL COMMENTS RE VARIOUS SPECIFIC EMBODIMENTS

Figure 1:
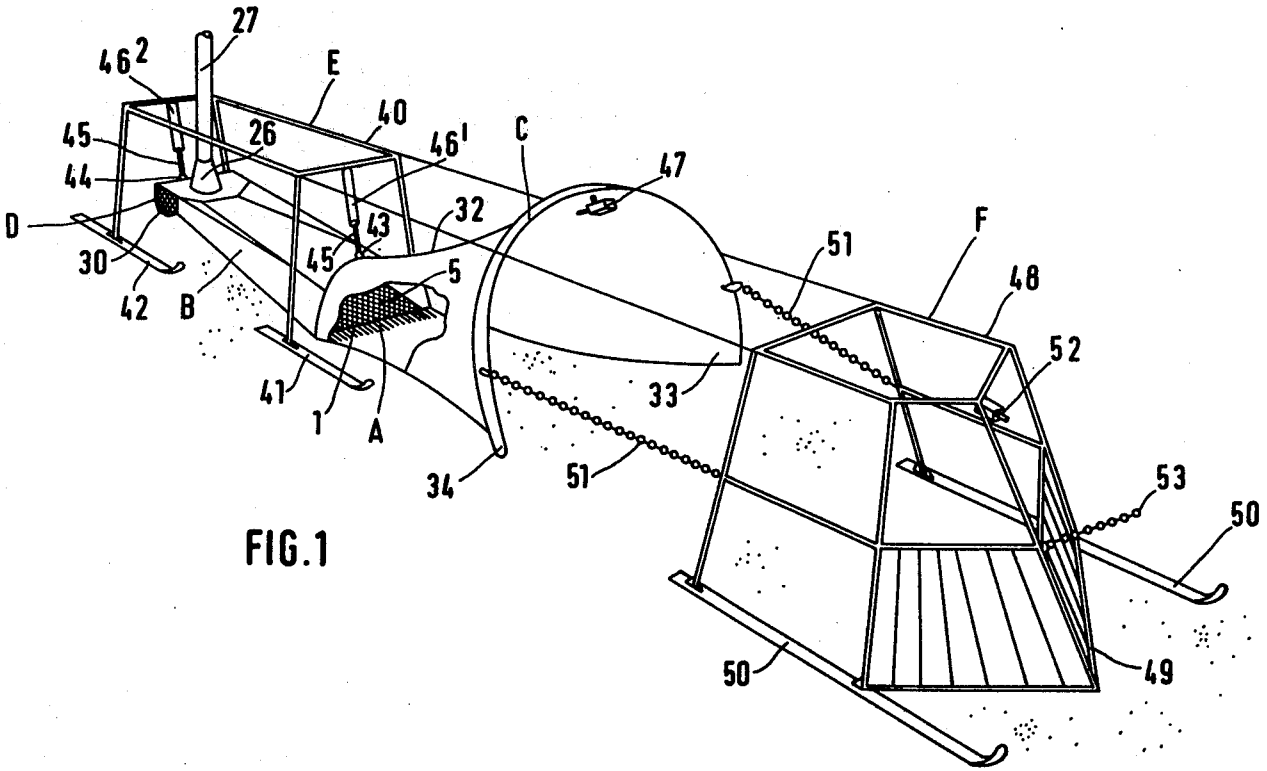
FIG. 1 is a view in perspective of a first embodiment of the apparatus.
Figure 2:
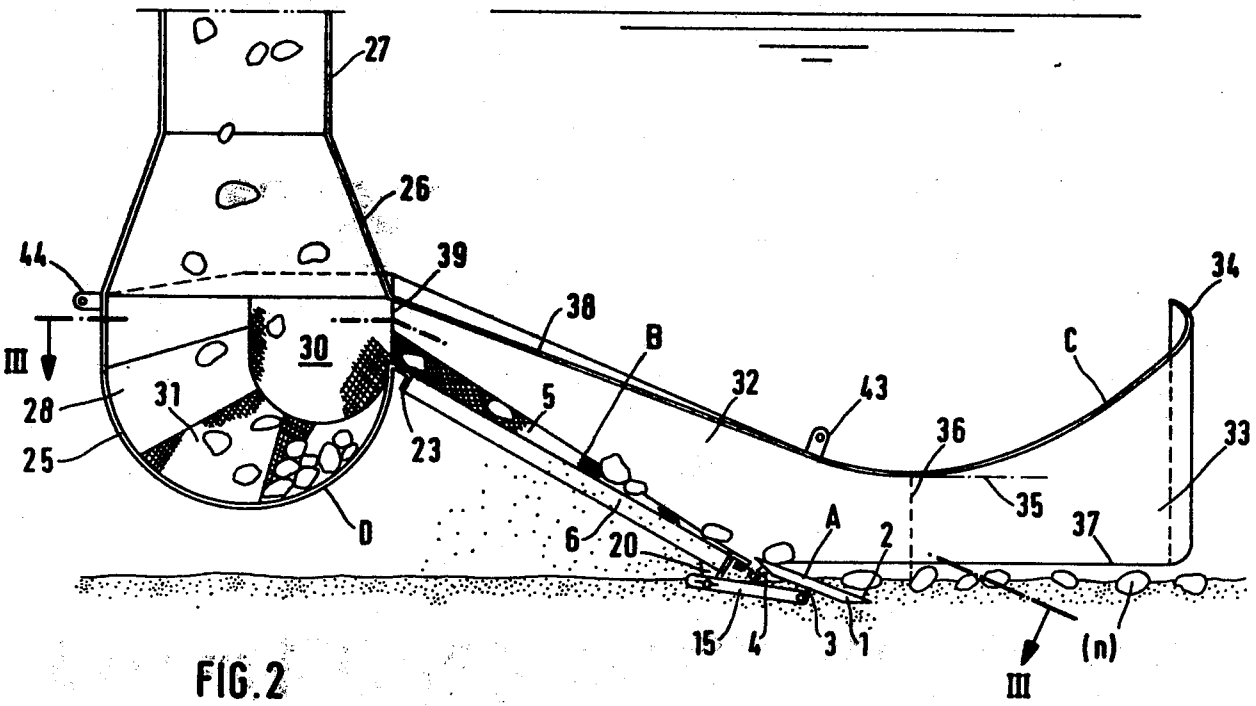
FIG. 2 is a vertical section along the longitudinal axis of the apparatus of FIG. 1.
Figure 3:
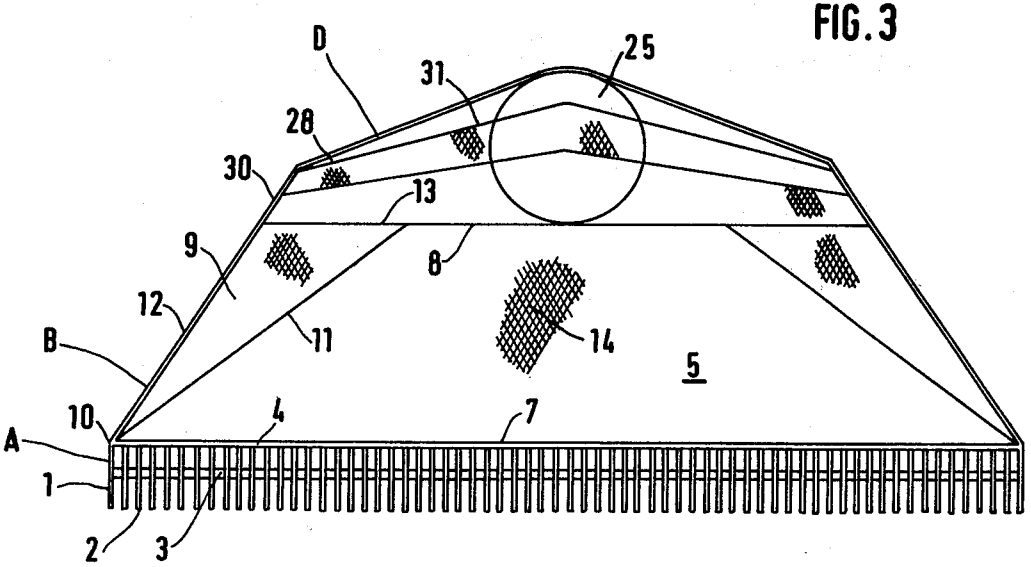
FIG. 3 is a section taken on the line III—III of FIG. 2.
Figure 4:
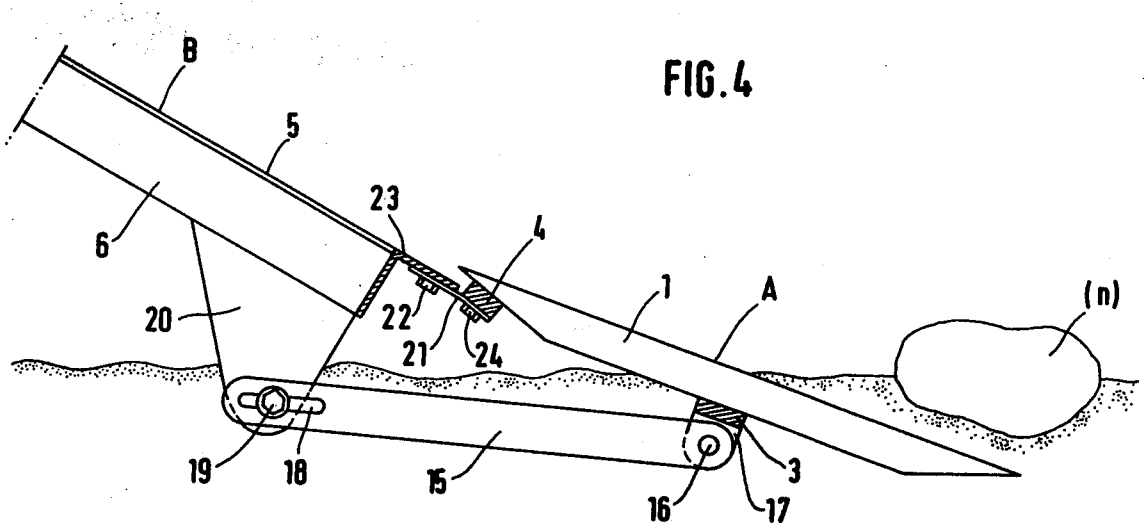
FIG. 4 is an enlarged portion FIG. 2.

These general comments apply to the first, second or third embodiment, or to each of them, and to various other embodiments.

According to the following embodiments of the invention, the apparatus comprises the following parts: a lifting device such as an inclined grating, which takes hold of the solid elements which one wishes to collect from parasitic material with which they are associated on the sea floor; a driving device which produces a relative velocity between the said grating and the water; a convergent casing surrounding the lifting device and designed to accelerate the fluid, i.e. the ocean water, so that it will entrain the solid elements more efficiently; an inclined surface forming an extension to the lifting device and in particular designed to free the solid elements from the parasitic material during their ascent of the inclined surface; and a collection chamber.

In general, the lifting device is preferably in the form of an inclined comb in which the spaces between the teeth are slightly smaller than the smallest dimension of the smallest elements which one wishes to collect. In this way, elements of parasitic material which are smaller in size will fall through the spaces between the teeth and will not be carried along.

For example, one may employ a flat comb with teeth made of wire or metal strips or rods which present a high moment of inertia in the direction of the effort required to move the device forwards in the layer where the nodules are situated. The front ends of these small rods may be chamfered or pointed to facilitate their forward movement through the silt. With this end in view, it is also desireable that the inclination of the comb be adjustable to compensate for differences in the depth of the layer to be treated (for example, of the order of several centimeters) and the nature of the layer and of the nodules.

Furthermore, the comb may be and preferably is composed of two or more parts differing from each other in their angle of inclination. The front part preferably has a greater inclination than the rear part. The component parts of the comb may or may not be joined together, and in the latter case the resultant space between the two parts may tend to promote by-pass of part of the flow.

To protect against damage to and blockage of the apparatus upon encountering projections on the ocean floor, feeler arms and/or a pyramidal bumper structure, V-shaped at the front, may be arranged in front of the lifting device. When these arms encounter various obstacles such as rocky outcrops, boulders or oversize nodules, the arms are lifted up by the obstacles. Through e.g. mechanical connections, the arms raise the nodule lifting device high enough to clear the obstacle. The bumper arrangement can push obstacles aside or cause the device to pass around them.

The number of combs placed side by side for selective raking is a function of the desired rate of intake of nodules, taking into account the speed of forward movement of the apparatus.

The nodule lifting device, e.g. comb, extends into or is followed by an inclined surface whose angle of inclination to the horizontal should be less than the critical angle of inclination at which the largest element to be collected ceases to move upwards because its weight and surface friction are not overcome by the force of the driving current, as will be described hereinafter. It is contemplated that the inclined surface may be provided with linkages for adjusting its angle of inclination in the longitudinal and transverse directions. Thus, the surface may be set at an optimum angle for collecting nodules of a given average weight and surface friction.

The inclined surface includes sufficient perforations or openings so that a substantial portion of the driving flow can escape through the openings, carrying with it parasitic material which would have accompanied the solid elements in their ascent, this being achieved without any moving mechanism or parts, solely by the thrust associated with the relative displacement between the water and the inclined surface.

The inclined surface may be in the form of a series of parallel rods or in the form of a perforated metal sheet or a grating of metal strips or wires. It should be understood that the inclined surface need not necessarily be plane but may include joints or be curved.

The distribution and form of the apertures in the inclined surface, combined with a suitable geometry of the upper parts of the inlet conduit, combine to form a semiclosed conduit or duct in which the velocity of flow ensures at every point the simultaneous upward movement and cleaning of the solid elements along the inclined surface. Thus, the gauge of the wire netting of the inclined surface may vary from one place to another so as to provide optimum distribution of the flow of liquid and of parasitic material across the apertures of the inclined surface. Also, clogging of the apertures of the inclined surface with solid elements or parasitic material can be prevented by suitable choice of the geometry of the apertures, and lozenge-shaped apertures are particularly suitable for this purpose. Also, clogging may be prevented by imparting to the water a direction of flow or turbulence which minimizes the velocity component of the particles perpendicular to and towards the inclined surface.

Since the width of the inclined surface at its base will normally be at least equal to that of the lifting device, and may reach a value of several meters, it may be necessary or desireable to laterally compress the stream of solid elements either in the course of their ascent of the surface or after their arrival at the top end of the surface if the collection chamber is narrower than the lifting device.

After their arrival at the top of the inclined surface, the solid elements enter the collection chamber, which may be set obliquely in relation to the relative velocity of the water and/or inclined to the horizontal. Collection of the solid elements is brought about by the driving force of the water and/or by gravity. The collection chamber may also serve to store the solid elements before their removal, and for this purpose it may be provided with one or more cavities.

The acceleration and duct means are preferably configured to induce a sufficiently large flow and velocity in the duct to accomplish substantial cleaning of the nodules and to drive them all the way to the collection chamber. This can be accomplished whether the duct which includes the inclined surface is an element which is connected to but distinct from the acceleration means, or is at least partly integral with the acceleration means. For instance, the convergent wall means of the water acceleration means may terminate in the vicinity of the lifting device and there connect with the upper and side confining means of the duct, or one may employ a casing or conduit in which the confining means of the duct are a continuation of the convergent wall means. Said conduit has a convergent inlet and lateral surfaces which are partially formed by the inclined surface and completed by a casing. The relative velocity of the water is substantially increased in this conduit, thereby enabling the solid elements to ascend the inclined surface more easily.

The convergent casing or conduit may have any general shape, but certain parameters such as the position of the inlet section and the angle of convergence are preferably adjustable so that the magnitude and orientation of the velocity vector of the water can be regulated. According to the present embodiments, the inlet of the conduit is shaped so as to take in as large a flow of water as possible while preventing any sudden changes in the flow velocity. Avoidance of sudden changes tends to reduce unproductive pressure drop in the conduit. The profile of the conduit preferably has the following characteristics: it should catch a sufficiently high intake of water to ensure that the nodules will be driven at a substantially or much higher velocity than the velocity of displacement of the apparatus relative to the water; at the same time, the velocity of this inflow should be sufficient for causing efficient cleaning of the solid elements; the maximum velocity should be obtained in the region where the comb penetrates the moveable layer. By this it is meant that the longitudinal positon of the maximum convergence of the conduit walls (and therefore the minimum cross-sectional area and maximum velocity in the conduit) is preferably exactly in or at least adjacent to (including ahead of and to the rear of) that location in the device where the lifting means penetrates the subsoil. More preferably, the maximum velocity is exactly in, or adjacent and to the rear of, said location. In some cases, it may be desireable to configure the conduit walls in or near said region to produce in the water a velocity vector which is inclined upwardly or downwardly to the horizontal. Also, if desired, a convergent effect can be produced in the transverse direction to facilitate gathering of the nodules towards the center of the conduit. The amount and velocity of flow should be sufficient to move the nodules easily from the top of the inclined surface into the collection chamber.

The front part of the causing of the conduit may and usually will extend further forwards than the lifting device, and in this region it may also define a conduit with the ground, the lateral continuity of this conduit being provided by two elements capable of penetrating the ground where the casing is level with the ground. The lateral surfaces of the casing forming a conduit with the ground may be plane or curved.

To prevent the casing being lifted up by the force of the current, stabilizers, for example fins, may be attached to the casing or to members in contact with it.

The rear part of the casing may also serve as upper walls and/or lateral walls for the collection chamber. In this region, it may have apertures for the passage of water and/or parasitic material.

The units comprising these parts, that is to say, the lifting device, inclined surface, flow conduit and collection chamber, are preferably mounted on a carriage frame which may be equipped with skis or telescopic wheels. These latter elements may have an independence of movement enabling them to adapt themselves to the configuration of the ground. It is also possible to construct a composite apparatus combining on one and the same support one or more apparatus of the kind described above, which apparatus may be displaced by a common drive means. The connection between the parts of the apparatus and the carriage frame may be provided by any jointed parts optionally in combination with jacks and/or shock absorbers enabling the operation of extraction of the nodules to be carried out under the most stable conditions possible.

According to one embodiment of the invention, the carriage frame has a V-shaped screen in front, for example, of the type used in snow plows, but with openings for the passage of fluid, for example, in the form of a series of rods spaced apart, the spaces between the adjacent rods being equal to the dimensions of the largest solid objects which it is desired to collect.

The carriage frame may also carry any measuring or control device used for the operation of extraction, for example, a television camera.

The above-described apparatus may be used, for example, to collect polymetallic nodules characteristically having dimensions of between 10 and 100 mm. These nodules are at least partly buried in the clay at the bottom of the ocean. The invention makes possible a mode of operation which is entirely hydrodynamic without recourse to any extrinsic source of energy close to the apparatus.

The embodiments can be operated in various ways, including a process which is characterized in that a unit of lifting devices is displaced in relation to the water and the velocity of this displacement is utilized for releasing the solid elements. The operation proceeds in the following stages: (a) the solid elements are grasped and lifted by the mechanical lifting devices while a substantial proportion of the parasitic material with which they may be surrounded is left in place; (b) the solid elements are caused to ascend an inclined surface by the relative velocity of the water; (c) if indicated these solid elements are freed from the parasitic material during their ascent of the inclined surface; and (d) the elements are collected in a collection chamber.

The invention thus enables initial separation of the nodules from the slit to be carried out with an apparatus which has no moving parts or mechanism, the at least partial separation of the solid elements from the parasitic material being achieved solely by the movement of the lifting device in relation to the water. The invention also enables displacement of the solid elements from the place where they are first seized to the place where they are collected to be achieved solely by the action of water moving in relation to the parts forming the inclined surface and the collection chamber, without the supplying of any energy other than that necessary for maintaining this relative movement.

FIRST EMBODIMENT

The collecting device A of the apparatus shown in FIGS. 1–4 comprises a selective rake in the form of a flat comb 1 inclined to the ground at an angle of about 20°. This comb penetrates the ground to a depth slightly greater than the maximum depth to which the nodules are buried in the layer of parasitic material, say about 50 mm. The teeth of the comb are small bars of rectangular cross-section, of which the small side 2 perpendicular to the direction of forward movement, has a width of 2 mm, a height of 20 mm and a length of 300 mm.

These teeth therefore present a large moment of inertia in the direction of the effort required for forward movement in the layer where the nodules are situated.

These bars are chamfered over part of their length penetrating the ground so as to facilitate the forward movement. They are welded to two horizontal plates 3,4 arranged to provide optimum penetration of the bars in the ground. The space between every two adjacent bars is adapted to the minimum dimension of the solid elements to be extracted, namely 10 mm.

The width of the comb, that is to say, the effective width of the apparatus, is proportional to the desired rate of intake of the nodules which are to be collected, taking into account the velocity of forward movement of the apparatus.

The angle of inclination of the comb is adjusted according to the depth of the layer to be treated and the nature of the layer and of the nodules.

The adjustment device will be described later.

The inclined surface B of the apparatus consists of a grating 5 of wires made of rust-proof metal.

The grating is supported on a frame 6.

The inclined surface is composed of three plane elements in the form of wire mesh.

The central element is trapezoidal in shape (FIG. 3), the large base 7 of the trapezoid being the edge of connection to the comb 1 and the small base 8 forming a portion of the line of connection to the collecting chamber D of the apparatus. This central element of the inclined surface is at an angle of about 30° to the horizontal.

The lateral elements 9 are symmetrical and have the form of triangles. In each of these triangles, an apex 10 is one of the ends of the connecting edge between the comb and the inclined surface. One of the adjacent sides is one of the non-parallel sides 11 of the trapezoid constituting the central element of the inclined surface, while the other adjacent side is a straight line 12 forming an angle of about 40° with the horizontal. The side 13 of the triangle oposite apex 10 completes, together with the corresponding side 13 of the other triangle, the line of connection of the collecting chamber D for the nodules.

The apertures of the netting are lozenge-shaped 14 having diagonals measuring 12 mm and 8 mm respectively.

The length of the inclined surface is about 1 meter.

The angle of inclination of the comb 1 (FIG. 2) is controlled by linkages or levers 15 (FIG. 4) which at one end are hinged on pivots 16 mounted on lugs 17 projecting from the plate 3 while at the other end they have a slot 18 for engagement of the screw 19 by which they are fixed to a shoulder 20 integral with the frame 6.

The comb 1 and frame 6 of the inclined surface B are joined together by a flexible connection formed by a piece of sheet metal, for example, a piece of spring steel 21 fixed to an angle iron 23 on the frame 6 by bolts 22, and to the plate 4 of the comb by bolts 24.

The collecting chamber D comprises an approximately cylindrical central part to the top of which is connected the converging inlet 26 of the suction or pump pipe 27 for the solid liquid mixture.

The chamber further comprises two lateral parts 28 in the form of truncated combs having their large base connected to the central element 25 and the small base 30 forming an extension to the sides 12 of the machine. The conicity of the lateral part 28 produces a slope which favors collection of the nodules in the central elements 25 from which they are evacuated by pumping.

The surfaces forming the collecting chamber are made of sheet metal with the exception of the small base 30 of the two truncated cones 28 and of the lower rear part 31 of the three aforesaid elements, which are made of wire netting. The mesh of the netting is suitably chosen to enable water to be sucked across the lateral surfaces 30 and residual mud to be evacuated across the surfaces 31.

The casing C of the apparatus, arranged in front of and around the apparatus, has the form of a conduit with convergent inlet 32. At the front, the casing has a convergent surface 33 in the form of a slightly curved horn whose inlet edge 34 is suitably curved to confer on it good hydrodynamic properties.

In the vertical plane of symmetry of the apparatus, the lowermost point 36 situated on the horizontal tangents 35 is situated in front of the line where the comb 1 enters the ground. The part of the casing situated in front of the apparatus is delimited below by a horizontal edge 37 which is at a distance of about 10 cm from the ground. The part 38 of the casing situated above the inclined surface B is limited below by the edges 12 of this surface. Furthermore, the height by which the casing is situated above the inclined surface decreases from the front backwards until at the line of connection 39 with the collecting chamber D it amounts to only 1.5 to 2 times the maximum dimension of the nodules to be extracted.

The support E for the apparatus is in the form of a gantry 40 equipped with four skis 41, 42. Two front skis 41 are placed at the side of the line of penetration of the comb into the ground. The other two skis 42 are situated behind the apparatus. The apparatus is connected to the gantry at two points, a point 43 on the casing situated in the vertical plane of symmetry of the apparatus above the line along which the comb penetrates the ground, and a point 44 situated in the same plane but behind the collecting chamber for the nodules n.

At each of these points are provided a hinged connection and connecting links 45 for connection to the framework, equipped with a jacks $46^1$ and $46^2$ electrically controlled from a distance.

Guide means are provided to prevent lateral displacement of the apparatus in relation to the carriage.

The front jack $46^1$ serves mainly to control penetration of the comb into the ground. The rear jack $46^2$ is provided mainly to control the angle of inclination of the inclined surface and the comb.

A television camera 47 placed in the upper part of the inlet 33 of the casing and operated with lights also placed in the casing, can be used to control the depth of penetration of the comb into the ground.

At the front of the apparatus, a pyramidal structure 48 made of sectional elements has a V-shaped device 49 at the front, made of bars spaced apart by a distance equal to the maximum diameter of the nodules which are required to be extracted, for example, 10 cm. This device has the form of a snow plough. This device with bars has a ground clearance of from 10 to 15 cm.

The whole pyramidal structure rests on two skis 50 which makes it very stable. It applies horizontal traction to the apparatus and its gantry by means of chains 51.

The state of the ground can be monitored and in particular the presence of large obstacles requiring intervention to safeguard the apparatus can be registered by means of a television camera 52 placed in the front of the pyramidal structure.

A tractor chain for moving the carriage frame (E + F) of the apparatus forwards is represented at 53.

SECOND EMBODIMENT

Figure 5:
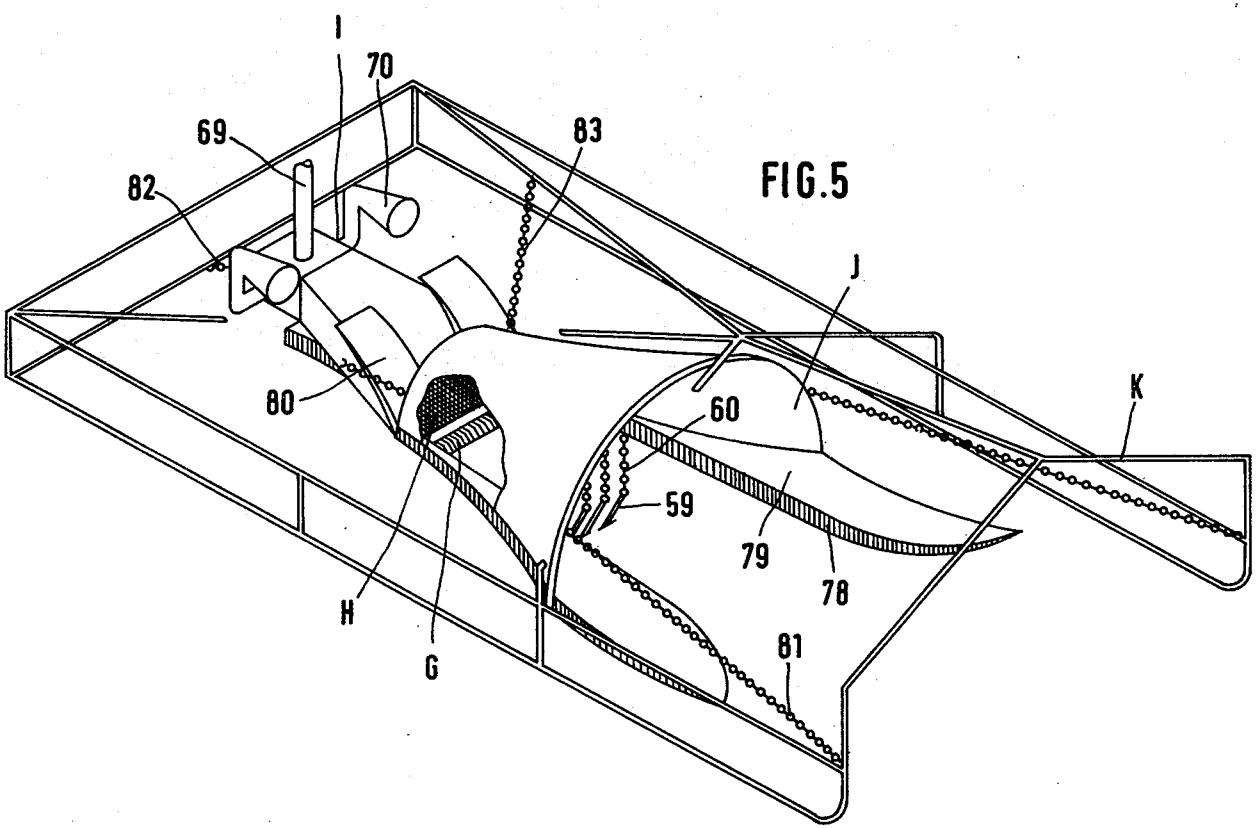
FIG. 5 is a view in perspective of a second embodiment of the apparatus.
Figure 6:
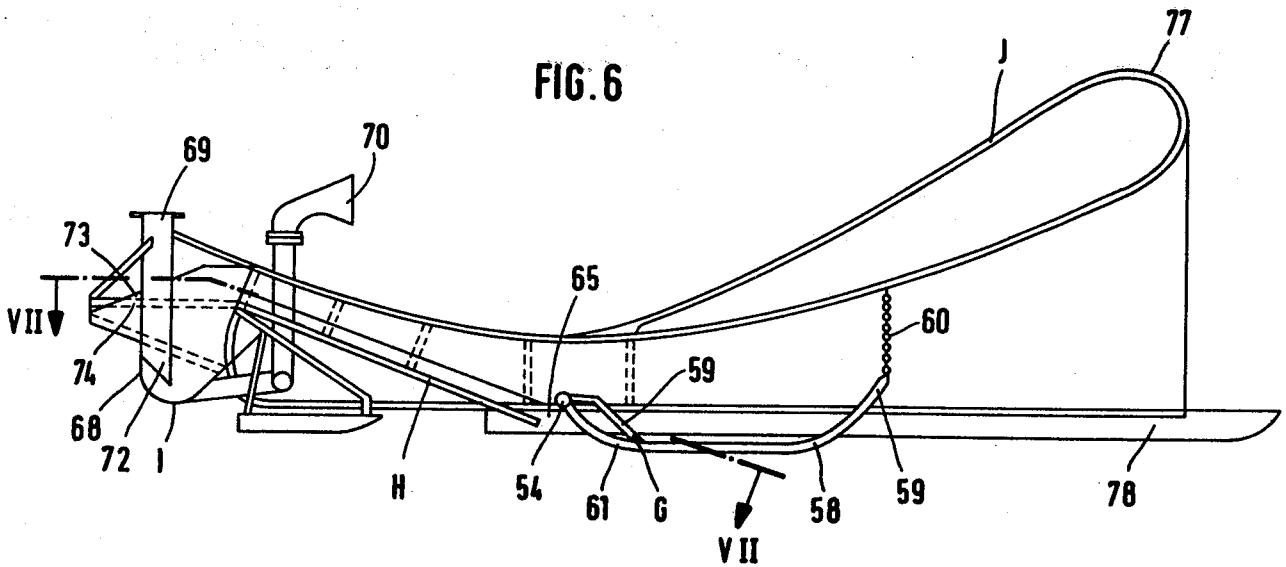
FIG. 6 is a vertical section along the longitudinal axis of the apparatus of FIG. 5.
Figure 7:
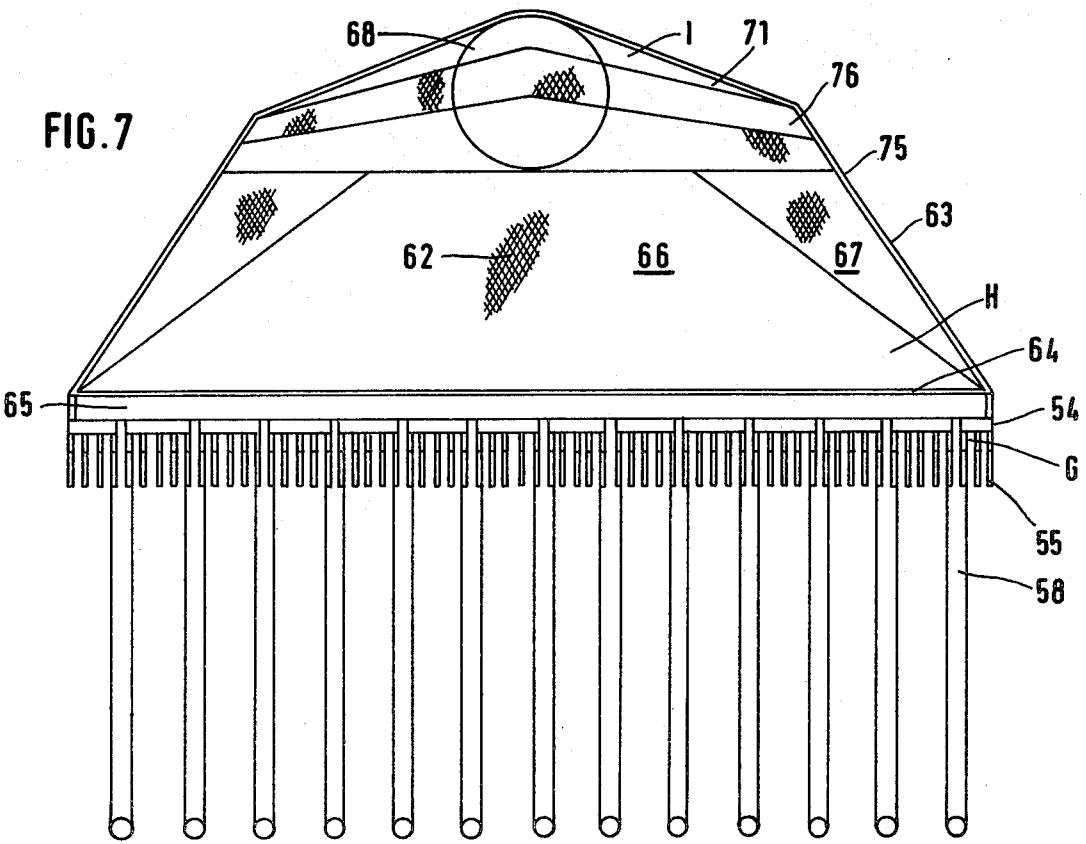
FIG. 7 is a section taken on the line VII—VII of FIG. 6.
Figure 8:
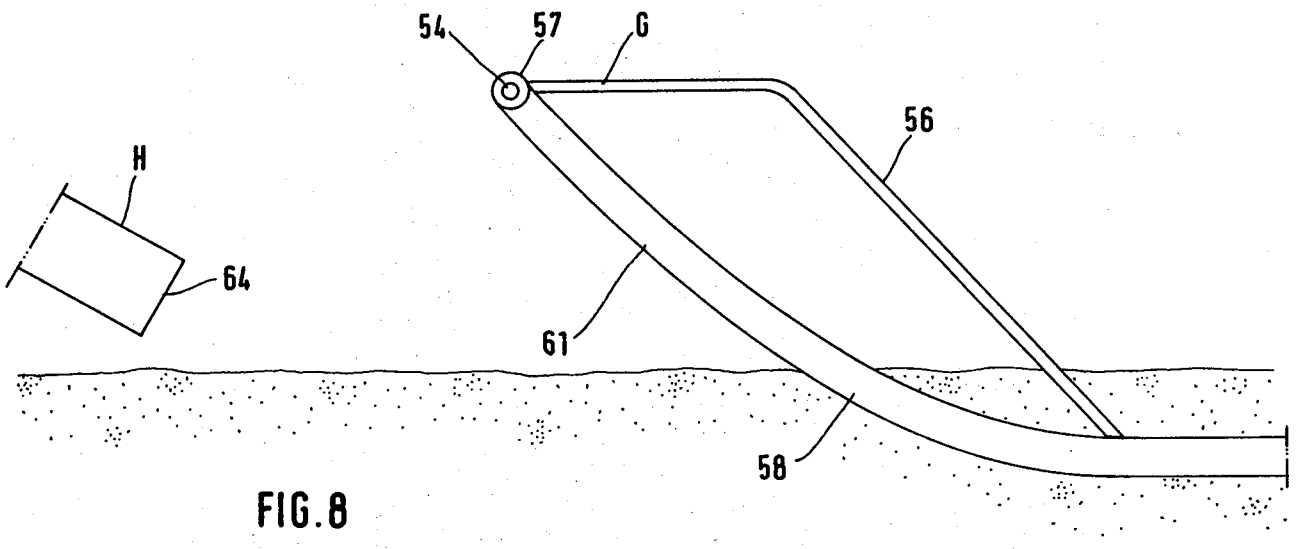
FIG. 8 is an enlarged portion FIG. 6.

In the particular form shown in FIGS. 5–8, the lifting device G comprises an assembly of raking elements placed side by side and free to undergo angular displacements independently of each other about a common axis of rotation 54 (see FIGS. 6 and 7).

Each of these raking elements is a comb 55 having teeth in the form of small bars of circular cross-section. The rear ends of these teeth are attached to a tube 57 mounted on their common axis of rotation 54. The front parts 56 of the teeth are curved forward and are disposed at an angle of about 45° relative to the rear parts.

In the normal operating position, the front parts of the teeth penetrate the parasitic layer, preferably to a depth slightly greater than the maximum depth to which the nodules are buried in the parasitic layer. The rear parts of the teeth are approximately parallel to the parasitic layer, or may incline rearwardly and upwardly at a smaller inclination, such as for instance about 20°. The front parts raise the nodules from the sea bed to the rear parts of the teeth. If some of the parasitic layer is not sufficiently sticky to ascend the front parts of the rear parts, contact between the layer and the front parts commences the separation of the nodules and silt. If the material of the parasitic layer is sufficiently sticky to ascend as a layer to the rear part of the comb, its passage over the intersection of the front and rear parts tends to break up the layer, thus commencing or facilitating separation of the nodules therefrom.

Feeler arms are connected with the combs, so that each comb can be raised to an obstacle clearing position by either of the arms which adjoins it. Formed of rod stock, the arms 58 lie parallel to the direction of forward movement of the apparatus and extend forward of the fronts of the combs. The upwardly curved parts 59 of the arms are situated above the ground and carry rings for attachment of cables or chains 60 which are attached at their other ends to the casing of the apparatus. By this arrangement it is possible to prevent excessive penetration of the arms and comb teeth into the parasitic layer. At the rear, the arms extend beyond their point of attachment to or connection with the comb, into a piece 61 which is attached to the hinge tube so as to provide sufficient rigidity for the comb-arm unit.

In the embodiment shown in FIGS. 6 and 7, the inclined surface H is formed by a netting 62 of rust-proof wire having lozenge-shaped openings. This netting is supported by a frame 62, whose leading edge 64 is parallel to the axis of rotation of the combs and above thee subsoil. Between the rear of the lifting device G and the relatively lower leading edge of inclined surface H is a transverse gap 65 over which the nodules must pass to reach the inclined surface. The inclined surface includes a central element 66 and lateral elements 67. The central element is in the shape of a trapezoid having a large base, which forms the leading edge 64 described above, and a small base, which forms a portion of the downstream end of the inclined surface. This small base constitutes a portion of a line along which the inclined surface is connected to a collection chamber for the nodules. The lateral elements 67 are symmetrical and form triangles. In each of these triangles, one apex is at one of the ends of the large base of the trapezoid constituting the central element 66. One side of each triangle adjacent to this apex constitutes one of the non-parallel sides of the trapezoid, while the other adjacent side is a straight line set at an angle of 30° to the horizontal. That side of each triangle which is opposite to the above-mentioned apex completes the line of connection to the collection chamber.

In the present embodiment, the collection chamber I for the nodules comprises a central portion 68 in the form of a hopper into which plunges the end of the suction pipe 69 for pumping the solid liquid mixture. Pipe 69 is connected to the intake of a suction pump located on a surface ship. Two auxiliary pipes 70 for supplying water also open into this portion.

Champer I further comprises two lateral portions 71 in the form of truncated cones having their large bases connected to the central portion and their small bases forming extensions from the central portion to the sides of the machine. The collection chamber may be provided with a motor-driven archimedian screw designed to carry the nodules either towards the center of the collection chamber or towards its ends to be collected there by a suitable device, for example, the pipe of the abovementioned suction pump. However, in the present embodiment, the conicity of the lateral portions of the collection chamber produces a slope which promotes lateral gathering of the nodules into the central element from which they are evacuated by pumping.

The central portion 68 of the collection chamber comprises a cylindrical base shown in FIG. 6, the front of which is connected to the frame which supports the rear of the inclined surface H. The end of suction pipe 69 is substantially vertical and situated at the rear of the central portion 68 of the collection chamber. It has an inlet 72 which is chamfered at an angle of 45° and opens towards the rear so as to offer the minimum inlet section to solid elements moving towards the bottom of the collection chamber. Mixing action involving water and solid elements is effected or caused by water fed in through the auxiliary pipes 70 close to inlet 72. This mixing is to reduce the risk of the apparatus choking up with mounds of solid elements at the bottom of the central portion of the collection chamber. Persons skilled in the art will readily select appropriate dimensions for the bottom of the central portion 68 of the collection chamber, for the suction pipe 69, and for the auxiliary water supply pipes 70, proportional to the desired rate of flow of water and intake of nodules.

The upper parts of the central portion 68 and lateral portions 71 of the collection chamber comprise a perforated portion, i.e. an outlet to the sea indicated by reference numeral 73 in FIG. 6, to allow natural drainage or spillage of excess collected solid elements in cases where the rate of removal of the contents of the collection chamber by suction is insufficient to handle the rate of collection. The collection chamber also comprises an inclined netting 74 for the elimination of excessively large nodules which would otherwise enter the collection chamber. Netting 74 is positioned, as shown in FIG. 6, to extend from inclined surface H across the top of the collection chamber to outlet opening 73, so that oversize nodules rejected by the netting will be discharged at 73. It will be noted that this netting 74 therefore defines both the upper limit of the space for collecting nodules of the desired size and the entrance to the collection chamber. This netting or entrance is below the nodule path established by inclined surface H. Even though the netting is horizontal in this embodiment, it is inclined downwardly relative to the nodule path. Also the bottom of the collection chamber is below, i.e. at a lower level than, the downstream end of the inclined surface.

The surfaces of the collecting chamber may be made of sheet metal. However, the small base 75 and the lower part of the two truncated cones 76 can be in the form of netting to allow removal of residual mud.

As shown in FIGS. 5 and 6, the casing J arranged in front of and around the apparatus, has the form of a conduit with converging inlet. At the front, this casing has a convergent surface in the form of a horn of slight curvature whose edge 77 is curved to confer on it good hydrodynamic properties.

In the vertical plane of symmetry of the apparatus the low point of the convergent surface, situated on the horizontal tangent, is situated in front of the line where the combs penetrate the ground. The part of the casing situated in front of this position is delimited below by plates 78 which penetrate the ground and which are spaced apart by a distance corresponding to the total width of the combs. These plates extend forwards to the front of the apparatus to prevent nodules escaping sideways as the lifting device approaches them. Furthermore, the plates are fixed to the casing by means of horizontal surfaces or skids 79 in contact with the ground so as to enable the casing to slide over the ground and any projections on it. These skids extend backwards along the lower edges of the casing as far as the rear end.

The part of the casing situated above the inclined surface is delimited below by the edges of this surface. Moreover, the height to which it rises above the inclined surface decreases from the front backwards until, at the line of connection with the collecting chamber, it drops to a value of 1.5 to 2 times, or more preferably 3 to 4 times, the maximum dimension of the nodules to be extracted.

The casing of the apparatus further comprises fins 80 to stabilize it on the ground.

Another example of the driving device is shown in FIG. 5, in which the apparatus is placed inside a tractor sledge k, the constituent parts of which are made of tubing or sections. The apparatus is connected to the sledge by traction cables or chains 81 at the front, 82 at the rear and 83 at the top of the apparatus. These cables or chains may be equipped with shock absorbers and springs. The weight of this tractor is calculated so that it cannot be lifted up by the ascending vertical component of forces transmitted to it by the pipes and/or cables and traction chains.

THIRD EMBODIMENT

Figure 9:
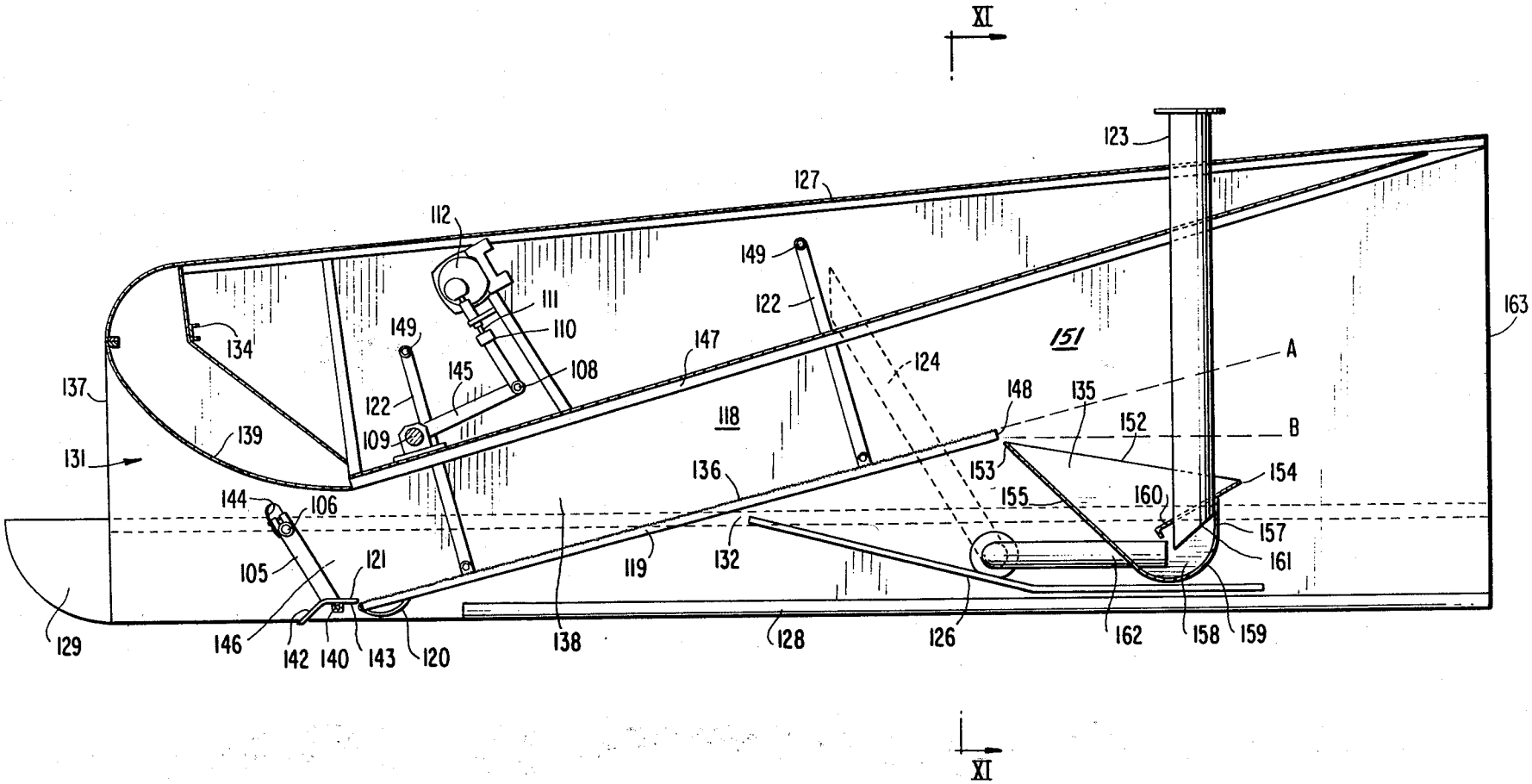
FIG. 9 is a vertical section along the longitudinal axis of a third embodiment of the apparatus.
Figure 10:
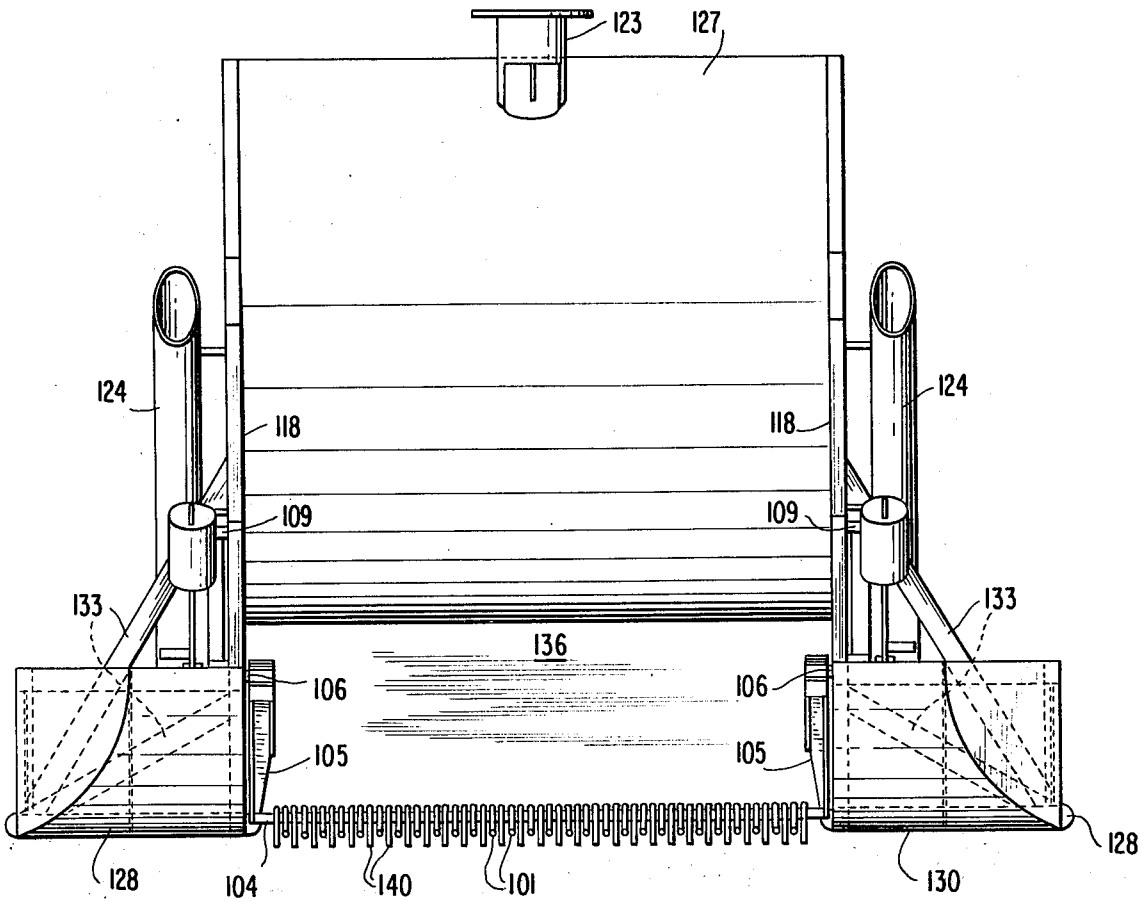
FIG. 10 is a front view of the apparatus of FIG. 9.
Figure 11:
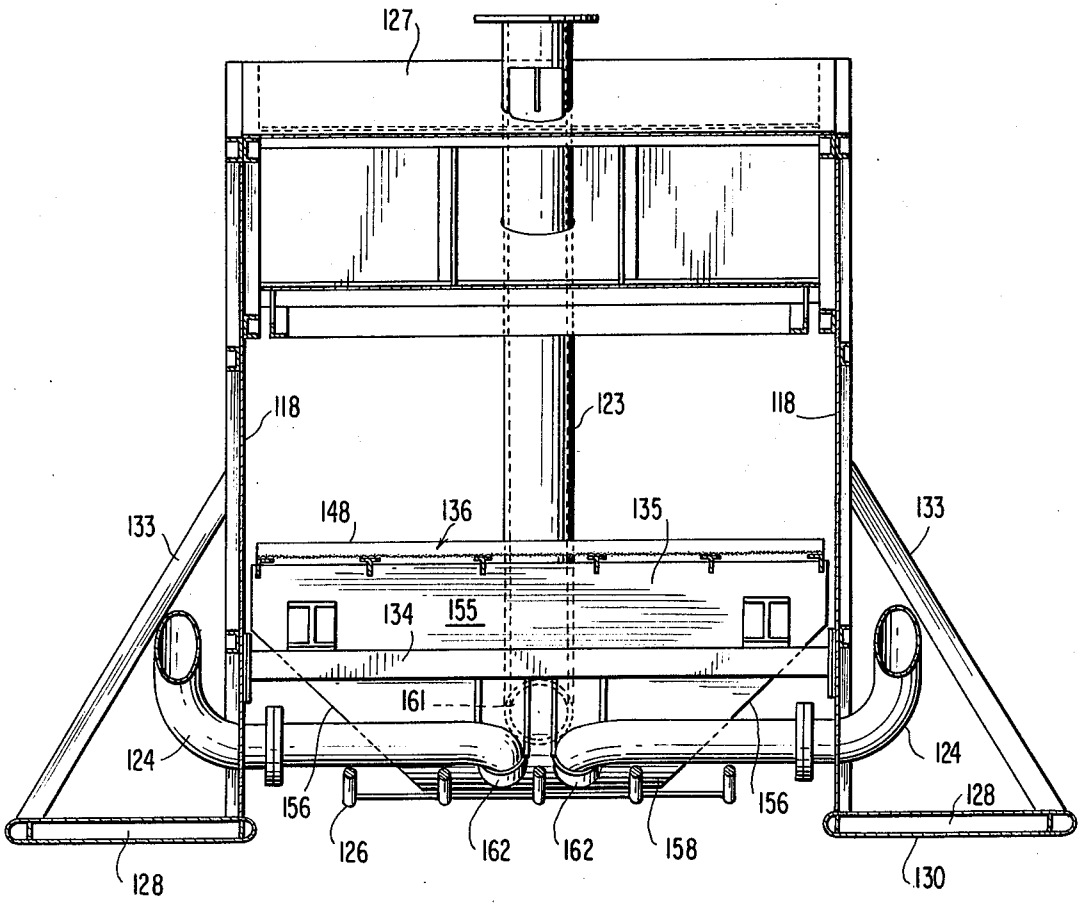
FIG. 11 is a vertical section along section line XI—XI of FIG. 9.

According to a third embodiment of the apparatus shown in FIGS. 9–12, the device is adapted to be transported along the surface of the sea bed on large skates 128 or other suitable transport means. For instance, as shown in FIGS. 10 and 11, these may include longitudinally elongated bearing surfaces 130 extending along both sides of the apparatus and extending outwardly relative to the side walls 118 to be described hereinafter. Persons skilled in the art will readily supply alternative forms of transport means and provide the latter with adequate bearing capacity. By way of example and not limitation, the skates 128 of the present embodiment may be made sufficiently large so that the load thereon is on the order of 250 kilograms per square meter or less. When skates are used, their front portions 129 may each be curved upwardly as viewed in longitudinal cross section (FIG. 9), in order that they may ride over obstacles more easily. Also, or alternatively, the outer edges of said front portions may diverge in the rearward direction, like the bow of a boat, to thrust outwardly the silt of sediment displaced by the skates. If said front portions extend forwardly of the wall means defining water acceleration means 131 it will tend to increase the stability of the apparatus.

The side walls 118 are generally imperforate, at least in the region of the water acceleration means 131; in this embodiment, they are generally imperforate throughout the length of the device. Thus, walls 118, one on each side of the device, extending throughout its length, may be fabricated for example of sheet metal, fiberglass reinforced resin or other suitable material. Such walls may be stiffened and held in place by an exteriorly mounted grid-work or frame 132 and supported in generally upright position on skates 128 by any suitable bracing means, such as diagonal braces 133 visible in FIGS. 10 and 11. Lateral orientation of walls 118 relative to one another is provided by cross-frame members 134 (FIG.

9) provided at the front, rear and elsewhere throughout the apparatus.

If the apparatus has a closed upper surface, such as sheet metal cover 127, the latter may be inclined upwardly and rearwardly, similar to a wedge or spoiler. Thus, motion of the apparatus and its surface 127 through the water will produce a downward component of force on the apparatus which will help keep it in contact with the sea bed.

The underside of the device may be provided with suitable shields to protect it from damage by obstacles over which it passes. For example, a shield 126 formed of rigid rod stock, can be placed below the collection chamber 135, and may extend forwardly under part of auxiliary water supply pipes 124 and part of inclined surface 136, to be described below.

As shown in FIG. 5, the water acceleration means 131 of the present embodiment comprises an inlet 137 which may be provided if desired with protecting means (not shown) to bar the entry of objects which cannot readily pass through the duct means 138 to be described hereinafter. Such protecting means may be in the form of horizontally or vertically placed parallel bars or rods, or may be a grating or screen or the like. They protect the lifting means against obstacles and prevent at least a portion of the oversize materials which are encountered from entering the apparatus. "Oversize" refers herein to nodules and other materials of larger size than the maximum size intended for collection in the collection chamber 135. It is an advantage of the invention that it need not necessarily include any protecting means across the inlet 137, as shown in the FIGS. 9–12 embodiment.

As indicated above, the water acceleration means 131 is defined by wall means extending rearwardly of the inlet to define a channel having its bottom open to and adjacent the sea bed. The wall means converge rearwardly to provide progressively reduced cross-sections in the channel. Of course, the inlet and such cross-sections should be sufficiently large to accept nodules of the desired size. It is particularly desireable that the opening and cross-sections be sufficiently large to accept at least a portion of any oversize material encountered.

In the present embodiment, the wall means of the acceleration means includes side walls 118 and an upper wall 139, which converges smoothly without abrupt changes of direction toward the bottom of the apparatus. As indicated above, it is an advantage of the invention that the water acceleration means may be the sole means in the apparatus for accelerating the flow of water and nodules. Toward this end, the inlet opening 137 is sufficiently large, and the progressively reducing cross-sections provided by convergence of upper wall 139 are sufficiently reduced, to drive the nodules all the way up to collection chamber 135 without the assistance of moveable lifting means, pumps and jetting nozzles or other moving parts. The water acceleration means has a region of maximum wall convergence where lifting means 140 is situated. Aslo, the stream of water and nodules which is formed and accelerated in water acceleration means 131 may be caused to expand somewhat downstream of lifting means 140.

Wall 118, defining in part the sides of water acceleration means 131, may be slanted towards or away from the longitudinal axis of the apparatus, but are preferably vertical. While persons skilled in the art, having been provided with the present disclosure of the invention, may provide the side walls 118 with a variety of suitable surface configurations, such walls are preferably planar in the present embodiment. If the lower edges of the side walls are either part of or connected with a ground engaging portion of the apparatus either in the region of the water acceleration means 131 or mechanical lifting means 140, to be described below or elsewhere, such side wall means can then assist in preventing lateral escape of water and nodules in front of or along side the mechanical lifting means; accordingly, in the present embodiment, the lower edges of side walls 118 are connected with the inner edges of skates 128. In a particularly preferred embodiment, side walls 118 are substantially planar and substantially parallel throughout substantially their entire length, defining the sides of the water acceleration means and duct means, which duct means also extends alongside and beyond the collection chamber in the present embodiment.

In the present embodiment, mechanical lifting means 140 is disposed rearwardly of water acceleration means inlet 137 and extends across the lower portion of the channel defined thereby, extending transversely of the flow of water and nodules established by the acceleration means. Lifting means 140 is positioned for contacting the sea bed and dislodging nodules and at least a portion of the silt associated therewith and directing at least the nodules upwardly to a predetermined elevation. In such lifting, the nodules may remain in contact withe the lifting means over its entire front to rear length, or, if the velocity and configuration of the apparatus are appropriate therefor, the nodules may be carried upwardly on a trajectory which extends above and rearwardly of the lifting means.

In the present preferred embodiment, the mechanical lifting means includes at least one array of laterally spaced upwardly and rearwardly inclined elongated members which are sufficiently close together to lift nodules of the minimum desired size. Such arrays are subject to a variety of optional arrangements regarding the shape, inclination and length of the elongated members, and the support or suspension, moveability, upward and downward adjustment and control of the lifting means. A few of the possible optional arrangements are described below.

For example, in the present embodiment, the lifting means 140 is a comb whose elongated members are teeth 101 which may have any desired cross-section, but are conveniently of rounded and preferably circular cross-section. By way of example and not limitation, such bars may have a diameter on the order of about 5 mm, be spaced apart from one another about 15 mm, edge to edge, and penetrate the subsoil about two to three cm.

Figure 12:
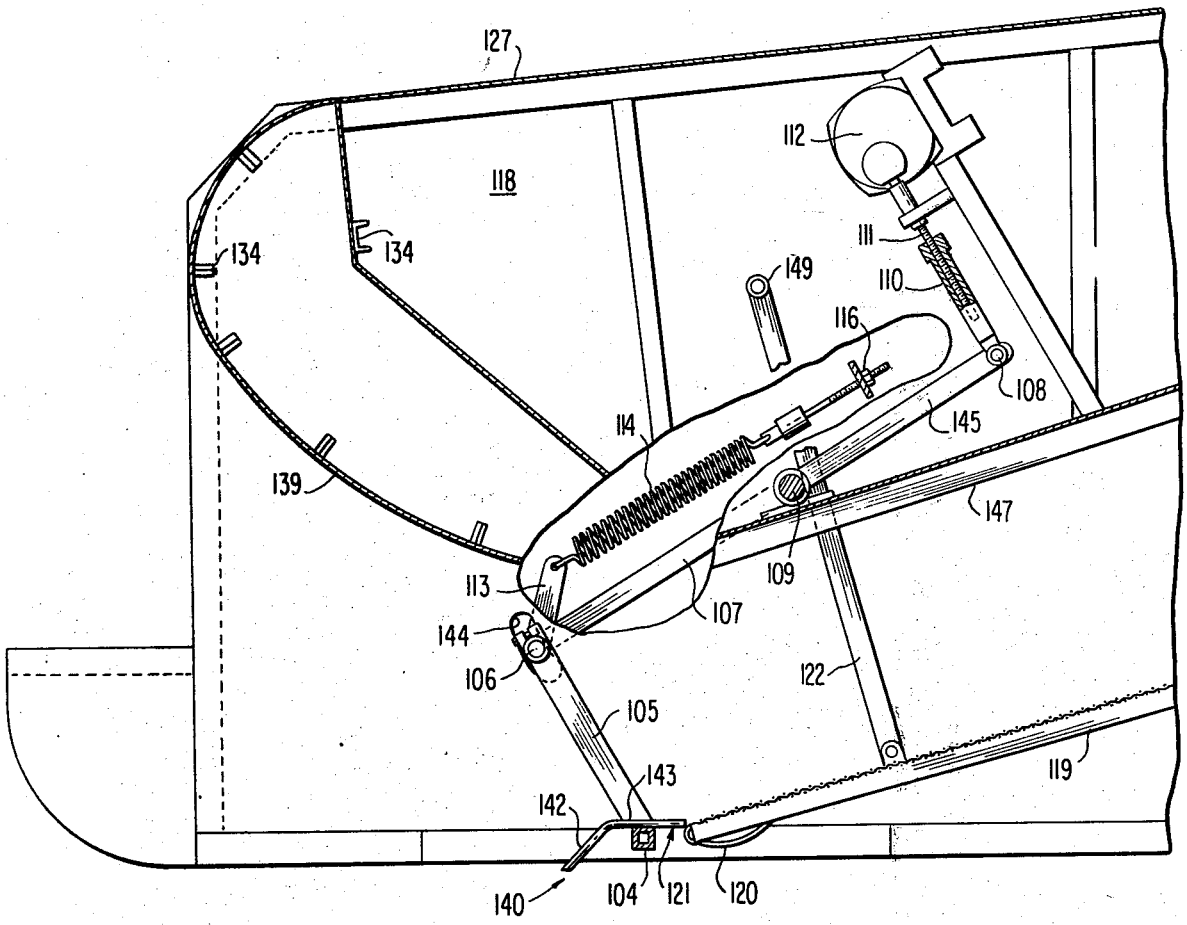
FIG. 12 is an enlarged portion of FIG. 9.

As seen in FIG. 12, the aforementioned elongated members generally have a ground engaging and penetrating foreportion 142 which is adjustably or non-adjustably inclined upwardly and rearwardly relative to the subsoil generally parallel to the longitudinal axis of the device. When the lifting means is in its normal operating position, this inclination may for instance be in the range of about 35° to about 60°, is preferably in the range of about 40° to 60°, and is most preferably about 50°–55°.

As an optional alternative, the elongated members may include hind portions situated at an angle to the fore-portions, and at a lesser angle of inclination with the sea bed than the fore-portions. For instance, in the presently preferred embodiment, the fore-portions 142 and hind-portions 143 are respectively at an angle of about 50° and approximately horizontal with the sea bed, said portions each representing about half the length of the elongated members. We have noted however that there can be an advantage in also inclining hind-portion 143 upward and rearwardly at an appreciably smaller angle of inclination than fore-portion 142, such as for example at an angle of about 20°.

Another optional feature is that the lower ends of the elongated members may or may not differ from one another in elevation. As exemplified in FIG. 10, a portion of said ends, in an alternating pattern, may extend further downwardly than the remaining ends. In the presently preferred embodiment, every other one is shorter than the others. By way of example and not limitation, the edge to edge spacing may be (a) up to about 50 mm between long teeth and (b) up to about 25 mm between a short tooth and its long neighbors, these spacings being 40 and 15 mm respectively in the presently preferred embodiment. The long teeth penetrate into the sediment, to the depth required to pick up the nodules which are buried therein. The length of the short teeth may be such that they terminate at, or a short distance above or below, the sea bed. They are able to pick up nodules lying on the surface of the sea bed, and their shorter length has the advantage that some of the silt in their path may pass beneath them and between the two neighboring longer teeth, thereby escaping being lifted up onto inclined surface 136 with the nodules. This tends to reduce the quantity of silt which must be handled on the inclined surface.

Another optional feature is that the above-mentioned short teeth can be fixed to a support which is independent from that on which the long teeth are fixed. Thus it is possible to provide for movement of the short teeth independent from the long teeth. Such movement can for example be used for cleaning the space between the teeth, when nodules become stuck between two adjacent teeth.

Whether lifting means 140 is fixed or moveable, it is preferred that it be normally stationary but moveable between a normal stationary working position and a recoiled position for obstacle clearance. In the embodiment of FIGS. 5–8, the mechanical lifting means includes a plurality of individually moveable arrays of said elongated members; but in the present embodiment there is a single array of elongated members, in the sense that the latter are all coupled together to move in unison between their normal and recoiled positions. While the previous embodiment showed the arrays of elongated members mounted on a shaft for rotation around said shaft to recoiled position, the single array of elongated members of the present embodiment is mounted on lever means suspended from shaft means whereby the lifting means swings from normal position to recoiled position. Thus, in the presently preferred embodiment (see FIG. 12), the bottoms of hind portions 143 of teeth 101 are attached to a transverse tube 104, each end of which is secured to and suspended from arms 105 mounted to swing clockwise and counterclockwise on rotatable transversely oriented horizontal stub shafts 106. Thus, when the lifting means encounters an obstacle, teeth 101, tube 104 and arms 105 swing rearwardly and upwardly in the counterclockwise direction to clear the obstacle.

The concept of a normally stationary lifting means does not however exclude the possibility of providing means for adjusting the elevation of the normal working position of the lifting means. A wide variety of mechanical and hydraulic arrangements can be conceived of for this purpose, but it is preferred to control the elevation of the lifting means by a motor unit 112 mounted within the body of the device beneath cover surface 127 and above duct 138. This unit has an output shaft connected to a jackscrew arrangement comprising screw 111 and nut 110. Nut 110 is connected through pivot 108 to lever 145, whose position can thus be adjusted and maintained by forward or reverse rotation of motor unit 112. The end of lever 145 opposite to pivot 108 is connected between side walls 118 to transverse shaft 109. This shaft extends all of the way through the apparatus, projecting outside each wall 118 through suitable bearings. A lever 107 is attached to each projection of shaft 109 and extends downwardly and forwardly along the outside of adjacent wall 118. Each lever 107 has at its forward end a collar or bearing in which one of the respective stub shafts 106 is mounted for rotation. The stub shafts extend from outside walls 118 through slots 144 and terminate inside said walls where they are attached to the above mentioned arms 105. Thus, motor unit 112 acting through screw 111, nut 110, pivot 108, lever 145, shaft 109 and levers 107 causes the stub shafts 106 to rise and fall in slots 144, raising and lowering the normal operating position of the lifting means.

Dragging the comb along the bottom will exert a certain amount of frictional drag on it, and if the comb is adapted to recoil as above described, it is desireable to provide means to bias it towards its normal working position. For instance, branch lever 113 may be secured to the projections of stub shafts 106 extending outside walls 118. Spring means 114 may be connected to levers 113 at an appropriate radial distance from stub shafts 106, and may have their opposite ends appropriately anchored on the apparatus by fasteners 116, so that the springs will be tensioned by — and therefore oppose — the drag forces on the lifting means.

An advantage is gained by locating levers 107, lever extensions 113, springs 114 and fasteners 116 outside the side walls 118. In such location, they will not disturb the flow of liquid established within the apparatus, as it passes through water acceleration means 131 and duct means 138.

Under certain circumstances, it will be beneficial to include means for determining the operating load on the lifting means. For instance, a measuring means capable of measuring the rearward reaction of the lifting means can provide information on whether the lifting means is penetrating the sub soil or not, and may furnish information on whether the extent of penetration is sufficient or excessive. Based on the foregoing disclosure and their background knowledge, persons of ordinary skill in the art will readily select appropriate transducers and appropriate means for further processing and utilizing the load-indicative signals. For instance, the signals may be transmitted to appropriate readout devices on a surface vessel for interpretation by operating personnel, or may be transmitted to automatic control devices either in the surface ship or on the apparatus itself on the sea floor. Such automatic control means may for instance interpret the load indicative signals and actuate the motor unit 112 for raising and lowering the normal operating position of the lifting device, maintaining a predetermined relationship between elevation and load, increasing and decreasing the elevation respectively in response to increased and decreased load.

The apparatus may include bridging means 121 to assist in delivering the nodules across any gap, if such exists, between the lifting means 140 and inclined surface. The bridging means may be in the form of bars, grids, screens, plates or any other suitable form. In certain circumstances it may be desireable for the bridging means to be flexible or even elastic, such as for example when the bridging means is secured to both a lifting means and an inclined surface which are designed to move independently of one another. However, FIGS. 9 and 12 illustrate the fact that the bridging means need not be secured to both the lifting means and the inclined surface and may for example be secured to only one of them. In this embodiment the bridging means 121 consists of laterally spaced extensions of the hind portions 143 which extend rearwardly of the lifting means 140 to touch or nearly touch the upper surface of the leading edge of inclined surface 136. These extensions may be integral with the bars forming the hind portions 143 or may be separate segments having an articulated or hinged connection with hind portions 143. In the case of hinged or articulated segments acting as bridging means, it is desireable that adjacent bridging means be coupled together in pairs at their rear ends to limit their displacement.

Duct means 138 includes an entry 146 which is connected with acceleration means 131. While these parts need not be directly connected, they should be joined in such a manner as to substantially preserve the velocity imparted to the water by the acceleration means. The confining means which define duct 138 include a ceiling 147, which may be for instance screen material or preferably unapertured sheet stock. Side walls 118 and inclined surface 136 complete the duct in the present embodiment. In general, the ceiling and inclined surface are preferably substantially parallel.

Inclined surface 136 includes openings which act as silt discharge means, the shape of the openings depending on the nature and quantity of silt. Thus, for example the openings may be elongated, lozenge shape or round, depending on whether the inclined surface is constructed of spaced parallel bars, screen material, or perforated sheet. Such material is conveniently supported on a frame 119 having a reinforced leading edge 120 parallel to, to the rearward of and slightly below the horizontal aft portion of comb 140, but sufficiently high that it will normally ridge above the sea bed.

Frame 119 may have any convenient combination of length and angle of inclination to the sea bed which will provide sufficient elevation to reach the inlet of collection chamber 135 and yet low enough so that the nodules can climb it. For example, angles in the range of about 10 to about 30° are quite acceptable, and an angle of 20° is used in the presently preferred embodiment. The upward, rearward inclination of inclined surface 136 tends to establish the flow of water and nodules in a direction which will project upwardly and rearwardly when passing beyond the downstream end 148 of this inclined surface.

While inclined surface 136 may be fixed in the apparatus, it is preferred that it be moveable between a normal stationary working position and a recoiled position for obstacle clearance. This may be attained for instance by suspending said surface from overhead pivots 149 by a group of four fore-and-aft swinging lever means 122. Four of such levers swing in slots (not shown) provided in ceiling 147. When an obstacle causes lifting means 140 to swing to its recoiled position, the obstacle will be struck shortly thereafter by leading edge 120 of frame 119, causing the frame to swing upwardly and to the right. Once the inclined surface has passed beyond the obstacle, it swings back to its normal working position by gravity. If necessary or desireable, spring means (not shown) can be provided to bias the inclined surface towards its working position.

In the present embodiment the collection chamber 135 is located at the downstream end 148 of inclined surface 136. As shown in FIG. 9, duct 138 need not necessarily be coextensive with inclined surface 136. The duct or portions thereof may for instance extend further downstream than the end of the inclined surface. In fact, it is advantageous if the walls 118, constituting the side confining walls of duct means 138, extend alongside the collection chamber for at least a portion of its length, and such walls may extend to the rearward end of chamber 135 or beyond it. Moreover, side walls 118 may represent at least a part of the side wall structure of collection chamber 135. However, in the present embodiment, such side wall structure is separate from walls 118. Also, ceiling 147, representing the upper confining wall of duct 138, may extend further longitudinally downstream than the downstream end 148 of the inclined surface. The ceiling may extend above all or a portion of the length of the collection chamber. When both ceiling 147 and side walls 118 extend above and alongside at least a portion of the length of the collection chamber, they together with the collection chamber, can provide a zone 151 of increased transverse cross-section above the collection chamber. This zone slows the stream of water and solid material departing inclined surface downstream end 148, thereby facilitating gravity release of nodules from the stream into the collection chamber.

Collection chamber 135 may be positioned beyond downstream end 148 of inclined surface 136. For instance chamber 135 may be spaced downstream from end 148 and either positioned under the natural trajectory of the nodules or positioned at the end of a rearwardly, downwardly disposed ramp (not shown) connecting downstream end 148 with the collection chamber. However, as shown in the present embodiment, the collection chamber is preferably located immediately adjacent the downstream end 148, with the collection chamber entrance 152 being at about the same or a slightly lower elevation than said downstream end.

Collection chamber entrance 152 preferably includes a front edge 153, positioned so that water and nodules discharged from inclined surface 136 will pass over it, and a rear edge 154, positioned so that oversize solid material can pass over it. These front and rear edges are generally below an imaginary plane A coinciding with the inclined surface and extending upwardly and rearwardly therefrom. More preferably, both of these edges are below an imaginary horizontal plane B projecting rearwardly from either the highest point on the inclined surface, or from its downstream end 148, or from both of the foregoing if they coincide. Still more preferably, rear edge 154 of the collection chamber is at a lower elevation than its front edge 153. The side edges of the collection chamber entrance may be above or below the above mentioned planes A and B, provided there is sufficient side wall structure to receive the nodules to be collected. In the present configuration, when the front and rear edges 153 and 154 are below plane A or plane B, the entrance of the collection chamber is thus turned away from the direction of water flow established by duct means 138; and when said edges are below plane B the entrance faces upwardly and rearwardly. Having the edges below one or both planes has the advantage that the main stream of water departing inclined surface 136 is not directly aimed into collection chamber entrance 152, so that there is less opportunity for any remaining silt entrained in such stream to enter the collection chamber.

It will be readily appreciated that the velocity of the device and the inclination of inclined surface 136 may be readily established at values which will insure that nodules of both the larger and smaller desired sizes will drop by gravity into the collection chamber entrance. When rear edge 154 is below the elevation of front edge 153, if it should happen that collection chamber 135 should temporarily contain an excess of solid material, such excess can discharge itself by gravity over the lower rear edge.

A grate, screen or equivalent device can be provided to cover the entrance of the collection chamber and thereby prevent entry of oversize materials. If this grate, screen or the like is at or below horizontal plane B and is inclined downwardly and rearwardly, oversize material can be continuously removed from the surface of the grate by the combined action of gravity and the flow of water emanating from duct 138. If the means for removing material from the collection chamber is an air lift system with a suction pipe having its inlet in the collection chamber, it is desireable to maintain a certain relationship between the openings in the grate or screen and the diameter of the suction pipe. In general, it is desireable to prevent material larger than half the diameter of the suction pipe from entering the collection chamber. Based on the foregoing disclosure and their own background knowledge, persons skilled in the art will readily select appropriate opening sizes for the screen, grate or the like; in the present preferred embodiment a grid having 10 cm square openings is employed.

The collection chamber may be of any suitable design. However, in the present embodiment, collection chamber 135 has the shape of a hopper. Its front wall 155 (FIG. 9) and lower portions of side walls 156 (FIG. 11), and optionally also the rear wall, 157 (FIG. 9), slope towards the bottom 158 of the chamber, which is below the downstream end 148 of the inclined surface 136. Bottom 158 is preferably a laterally centered portion of chamber 135. Also, bottom 158 is preferably more nearly adjacent the rear of the collection chamber than the front thereof, in which case rear wall 157 may be mostly vertical, joined to the bottom by a curved lower portion 159. This configuration promotes the gathering of the material in the lower portion of chamber 135 and facilitates removal of material therefrom by the suction pipe 123 of an air lift system (not shown).

As shown in FIGS. 9-11, suction pipe 123 enters through cover surface 127 at the top of the apparatus and extends down through collection chamber entrance 152 and baffle 160 (FIG. 9) into the lower portion of the chamber. The suction pipe inlet 161 is centered laterally (FIG. 11) and located towards the rear in the collection chamber. Baffle 160 is inclined upwardly and rearwardly towards rear wall 157 and extends laterally a sufficient distance on both sides of pipe 123 to serve as a barrier against solid material dropping directly from the rear part of collection chamber inlet 152 into bottom 158 adjacent suction pipe inlet 161. It has also been found beneficial for inlet 161 to be directed or turned away from collection chamber entrance 152, and for said inlet to be non-horizontal. The foregoing may be obtained by chamfering the inlet end of suction pipe 123 at a convenient angle, such as 45°, thereby offering the minimum inlet cross-section to solid elements traversing the bottom of the collection chamber.

It has also been found that suction pipe 123 can be operated more dependably if means are provided to cause mixing of the nodules with clear water in the lower portion of the collection chamber adjacent suction pipe inlet 161. This may be accomplished, for instance, by introducing water into the lower portion of the collection chamber by at least one water inlet other than the aforementioned entrance 152. For example, one may provide auxiliary pipes 124 having horn type water acceleration inlets (not shown) to receive clean water and direct it into inlets 162 (FIG. 11) in the lower portion of the collection chamber to stir up any nodules accumulated there. Inlets 162 are directed rearwardly through the sloping front wall 155 (FIGS. 9 and 11) towards the curved lower portion 159 of rear wall 157, thereby urging nodules from the bottom 158 up curved surface towards inlet 161. Water from auxiliary water inlets 162 which does not enter suction pipe inlet 161 is deflected by the underside of baffle 160, imposing a rolling motion on the nodules adjacent inlet 161. This generally reduces the risk of clogging by mounds of nodules accumulating in the bottom of the collection chamber. In order to promote efficient mixing, it is also considered desireable to limit the area of any horizontal portion of the collection chamber bottom, as compared to the cross-sectional area of the suction pipe 123. The size of the suction pipe 123 will of course be selected, based on available pumping capacity, to provide a sufficiently high flow rate to pick up the nodules. In general, it is desireable that the total cross-sectional area of the auxiliary water pipe or pipes 124 be about equivalent to or greater than the total cross-sectional area of the suction pipe or pipes 123. When auxiliary pipes 124 supply an amount of water which is substantially sufficient to meet the water demand of suction pipe 123, the collection chamber is then less likely to draw in through its entrance 152 any silt-laden water which may be discharged from duct 138.

The final outlet 163 of the device preferably takes a form which does not substantially impede the flow of water and nodules through duct 138. The transverse cross-sectional area of the final outlet should be larger than that of duct 138 at inclined surface downstream end 148, and preferably substantially larger. In the present preferred embodiment, the full width between walls 118 and the full height from the sea bed to the underside of ceiling 127 are open at the rear of the device, to provide a full height outlet 163.

From the foregoing it may be seen that the invention may be embodied in a variety of ways. With the benefit of the foregoing disclosure, persons skilled in the art will readily devise additional embodiments without departing from the spirit of the invention. Therefore the appended claims are to be construed as including the foregoing embodiments and all equivalents thereof.

What is claimed is:

1. Apparatus adapted to be transported along the surface of the sea bed for gathering nodules therefrom, which includes:

water acceleration means comprising an inlet with wall means extending rearwardly of said inlet to define a channel having its bottom open to and adjacent the sea bed, said wall means converging rearwardly of said inlet to provide progressively reduced cross-sections in said channel for generating therein a generally horizontal and longitudinal progressively accelerating flow of water whose velocity exceeds the rate of transport of said apparatus over the sea bed, said inlet and cross-sections all being sufficiently large to accept nodules of desired size;

mechanical lifting means, disposed rearwardly of said acceleration means inlet and extending transversely of said flow across the lower portion of said channel for contacting the sea bed and dislodging nodules and at least a portion of the silt associated with said nodules in the sea bed, and direction the nodules upwardly to a predetermined elevation, said mechanical lifting means being normally stationary but moveable between a normal working position and a recoiled position for obstacle clearance;

duct means having an entry connected with said acceleration means and including confining means defining a path for nodules received from said lifting means and extending downstream of said lifting means to a duct outlet, said confining means extending generally longitudinally above, below and to each side of said path, an inclined surface of said duct means having a generally horizontal transverse leading edge and a downstream end and extending upwardly and rearwardly relative to said leading edge for elevating a stream of water, nodules and any accompanying silt flowing rearwardly in said duct means, and silt discharge means extending through said confining means between said entry and outlet, said discharge means comprising openings in said inclined surface for discharging silt;

a collection chamber having an entrance at or beyond the downstream end of said inclined surface and positioned below said path to receive nodules from said path, the bottom of said chamber being below said downstream end.

2. Apparatus in accordance with claim 1, wherein said wall means include an upper wall and side walls.

3. Apparatus according to claim 2, wherein said upper wall converges toward the bottom of said apparatus.

4. Apparatus according to claim 2, wherein said side walls are parallel with one another.

5. Apparatus according to claim 1, wherein said wall means is curved when viewed in transverse-cross-section.

6. Apparatus according to claim 1, wherein said opening and cross-sections are sufficiently large to accept both nodules of desired size and at least a portion of any oversize material encountered by the apparatus.

7. Apparatus according to claim 1, wherein said opening and cross-sections are sufficiently large and said cross-sections are sufficiently reduced to drive nodules all the way to said collection chamber.

8. Apparatus according to claim 1, wherein said water acceleration means is the sole means in said apparatus for accelerating flow of water and nodules.

9. Apparatus according to claim 1, comprising a grating, screen or other means for protecting against the entry of oversize material into said acceleration means.

10. Apparatus according to claim 1, wherein said mechanical lifting means is in the region of maximum convergence of said wall means.

11. Apparatus according to claim 1, including bridging means extending from said lifting means to said inclined surface for transporting nodules from said lifting means to said inclined surface.

12. Apparatus according to claim 1, wherein said mechanical lifting means includes at least one array of laterally spaced upwardly and rearwardly inclined elongated members sufficiently close together to lift nodules of minimum desired size.

13. Apparatus according to claim 12, wherein said elongated members are all secured to a common support.

14. Apparatus according to claim 12, wherein at least the ground engaging portions of said elongated members are at an angle of elevation in the range of about 35° to 60° relative to the sea bed.

15. Apparatus according to claim 14, wherein at least a portion of the length of the elongated members above and adjacent the ground engaging portion is at an angle of elevation in said range.

16. Apparatus according to claim 12, wherein at least the ground engaging portions of said elongated members are at an angle of elevation in the range of about 40° to 60° relative to the sea bed.

17. Apparatus according to claim 12, wherein at least the ground engaging portions of said elongated members are at an angle of elevation in the range of about 50° to 55° relative to the sea bed.

18. Apparatus according to claim 12, wherein said elongated members include fore-and hind-portions, and wherein said fore-portions are disposed at a greater angle of inclination with the sea bed than the hind-portions.

19. Apparatus according to claim 12, wherein said elongated members are of rounded cross-section.

20. Apparatus according to claim 12, wherein said elongated members have lower ends for engaging the sea bed, a portion of said ends, in an alternating pattern, extending further downwardly than the remaining said ends.

21. Apparatus according to claim 1, wherein said mechanical lifting means is normally stationary.

22. Apparatus according to claim 21, wherein said normally stationary lifting means is moveable between a normal stationary working position and a recoiled position for obstacle clearance.

23. Apparatus according to claim 22, wherein said mechanical lifting means includes a plurality of individually moveable arrays of said elongated members.

24. Apparatus according to claim 22, wherein said mechanical lifting means are supported on transverse shaft means for movement between said normal position and recoil position.

25. Apparatus according to claim 24, wherein said mechanical lifting means are mounted directly on said shaft means for rotation from said normal position to said recoiled position.

26. Apparatus according to claim 24, wherein said mechanical lifting means is mounted on lever means suspended from said shaft means for swinging from said normal position to said recoiled position.

27. Apparatus according to claim 26, wherein said lever means is spring-biased toward and working position.

28. Apparatus according to claim 1, including means for adjusting the elevation of said lifting means.

29. Apparatus according to claim 1, wherein said leading edge is positioned at or below the elevation of the rear of the lifting means.

30. Apparatus according to claim 1, wherein said leading edge is positioned at an elevation such that it rides at or above the sea bed.

31. Apparatus according to claim 1, wherein said inclined surface is inclined for establishing the flow of water and any slit which may be dispersed therein in a direction which will project upwardly and rearwardly as it passes beyond the downstream end of said inclined surface.

32. Apparatus according to claim 1, wherein said silt discharge means includes openings in said inclined surface.

33. Apparatus according to claim 1, wherein said silt discharge means is a screened portion of said inclined surface.

34. Apparatus according to claim 1, wherein said inclined surface is normally stationary.

35. Apparatus according to claim 34, wherein said inclined surface is moveable between a normal stationary working position and a recoiled position for obstacle clearance.

36. Apparatus according to claim 35, wherein said inclined surface is suspended from overhead pivots by fore-and-aft swinging lever means.

37. Apparatus according to claim 1, wherein said collection chamber is positioned at the downstream end of the duct means.

38. Apparatus according to claim 37, wherein the entrance of said collection chamber is immediately adjacent the downstream end of said inclined surface.

39. Apparatus according to claim 1, wherein said collection chamber is entirely below an imaginary rearward projection of said inclined surface.

40. Apparatus according to claim 1, wherein the entrance of the collection chamber is turned away from the direction of flow of water established by said duct means.

41. Apparatus according to claim 40, wherein said entrance faces upwardly and rearwardly.

42. Apparatus according to claim 40, wherein said collection chamber is an open top hopper having upper edges at its front and rear which are below the elevation of the downstream end of said inclined surface.

43. Apparatus according to claim 1, wherein said collection chamber is provided with a grate or screen to prevent entry of oversize materials.

44. Apparatus according to claim 1, wherein said inclined surface is inclined upwardly for establishing the flow of water and any silt which may be dispersed therein in a direction which will project upwardly and rearwardly as it passes beyond the downstream end of the inclined surface, said collection chamber entrance faces upwardly and rearwardly, and said collection chamber is covered with a screen or grate to prevent entry of oversize materials, which screen or grate extends rearwardly and downwardly while diverging from the direction of flow established by said inclined surface.

45. Apparatus according to claim 1, wherein the said confining means of said duct means are longitudinal walls which extend beyond the rear end of said collection chamber.

46. Apparatus according to claim 1, wherein there is a zone of increased cross-section above the collection chamber for facilitating gravity release of nodules from said stream into said collection chamber.

47. Apparatus according to claim 46, wherein said zone of increased cross-section is defined by said duct means and collection chamber.

48. Apparatus according to claim 1, wherein a suction pipe, for removal of nodules, has its inlet in said collection chamber.

49. Apparatus according to claim 1, wherein the inlet of said suction pipe is turned away from the collection chamber entrance.

50. Apparatus according to claim 49, wherein said suction pipe inlet is chamfered.

51. Apparatus according to claim 48, wherein said collection chamber has at least one water inlet other than said entrance.

52. Apparatus adapted to be transported along the surface of the sea bed for gathering nodules therefrom, which includes:

water acceleration means comprising an inlet with wall means extending rearwardly of said inlet to define a channel having its bottom open to and adjacent the sea bed, said wall means converging rearwardly of said inlet to provide progressively reduced cross-sections in said channel for generating therein a generally horizontal and longitudinal progressively accelerating flow of water whose velocity exceeds the rate of transport of said apparatus over the sea bed, said inlet and cross-sections all being sufficiently large to accept both nodules of desired size and at least a portion of any oversize material encountered by the apparatus, said cross-sections being sufficiently reduced to drive nodules all the way to the collection chamber referred to below;

mechanical lifting means disposed rearwardly of said acceleration means inlet in the region of maximum convergency of said wall means and extending transversely of said flow across the lower portion of said channel for contacting the sea bed and dislodging nodules and at least a portion of the silt associated with said nodules in the sea bed and directing the nodules upwardly to a predetermined elevation into said flow, said mechanical lifting means including at least one array of laterally spaced upwardly and rearwardly inclined elongated members sufficiently close together to lift nodules of minimum desired size but allowing a substantial discharge of silt, said lifting means being normally stationary but moveable between a normal stationary working position and a recoiled position for obstacle clearance;

duct means having an entry connected with said acceleration means and including confining means defining a path for nodules received from said lifting means and extending downstream of said lifting means, said confining means extending generally longitudinally above, below and to each side of said path; an inclined surface of said duct means having a generally horizontal transverse leading edge and a downstream end, and extending upwardly and rearwardly relative to said leading edge for elevating a stream of water, nodules and any accompanying silt flowing rearwardly in said duct means and for establishing the flow of water and any silt which may be dispersed therein in a direction which will project upwardly and rearwardly as it passes beyond the downstream end of said inclined surface, and silt discharge means comprising openings in said inclined surface between said entry and outlet;

a collection chamber having its bottom below the downstream end of said inclined surface and having an entrance at or beyond said downstream end and positioned below said path to receive nodules from said path, said entrance being covered with a screen or grate to prevent entry of oversize materials, which screen or grate extends rearwardly and downwardly while diverging from the direction of flow established by said inclined surface; a suction pipe for removal of nodules, having its inlet in said collection chamber; and at least one water inlet into said collection chamber other than said entrance; and an outlet for said flow of water downstream of said inclined surface and collection zone and having a substantially larger cross-sectional area than said duct, measured at the downstream end of the inclined surface.

53. Process for gathering nodules from the sea bed, which includes:

providing apparatus including water acceleration means comprising an inlet with wall means extending rearwardly of said inlet to define a channel having its bottom open to and adjacent the sea bed, said wall means coverging rearwardly of said inlet to provide progressively reduced cross-sections in said channel, said inlet and cross-sections all being sufficiently large to accept nodules of desired size;

transporting said acceleration means along the surface of the sea bed for generating therein a generally horizontal and longitudinal progressively accelerating flow of water whose velocity exceeds the rate of transport of said apparatus over the sea bed;

mechanically lifting nodules from the sea bed and directing the nodules upwardly to a predetermined elevation into said flow rearwardly of said acceleration means inlet in a region extending transversely of said flow across the lower portion of said channel;

introducing said flow, nodules and at least a portion of any silt that may be associated with said nodules into duct means having an entry connected with said acceleration means and including confining means defining a path for nodules received from said lifting means and extending downstream of said lifting means to a duct outlet, said confining means extending generally longitudinally above, below and to each side of said path, an inclined surface of said duct means having a generally horizontal transverse leading edge and a downstream end and extending upwardly and rearwardly relative to said leading edge; and silt discharge means comprising openings extending through said inclined surface between said entry and outlet, continuing said flow along said duct means while discharging from the duct, through said openings, any silt dislodged from said nodules during said flow;

driving said nodules from said lifting means to the highest point of said inclined surface with the accelerated flow of water generated by the motion of said apparatus through the water;

establishing the flow of water and any silt which may be dispersed therein in a direction which will project upwardly and rearwardly downstream of said inclined surface; and introducing said nodules into a collection chamber having an entrance turned away from said direction of flow.

54. Process according to claim 53, wherein said opening and cross-sections are sufficiently large to accept both nodules of desired size and at least a portion of any oversize materials encountered by the apparatus.

55. Process according to claim 53, wherein said nodules are lifted from the sea bed in the region of maximum convergence of said wall means.

56. Process according to claim 53, including introducing said nodules into said collection chamber through a zone downstream of said inclined surface having an increased cross-sectional area relative to the cross-sectional area of said duct measured at the downstream end of said inclined surface.

57. Process according to claim 53, including the step of preventing oversize materials from entering said collection chamber.

58. Process according to claim 53, wherein said collection chamber entrance faces upwardly and rearwardly and said collection chamber is covered with a screen or grate which extends rearwardly and downwardly while diverging from the direction of flow established by said inclined surface, including the steps of preventing over-sized materials from entering said collection chamber using said screen or grate, and causing said over-sized materials to drop from the rear of the screen or grate.

59. Process according to claim 53, including removing nodules from said collection chamber by a suction pipe having its inlet in said collection chamber.

60. Process according to claim 59, including admitting water to said collection chamber through at least one water inlet other than said entrance.

61. Process for gathering nodules from the sea bed, which includes:

providing apparatus including water acceleration means comprising an inlet with wall means extending rearwardly of said inlet to define a channel having its bottom open to and adjacent the sea bed, said wall means converging rearwardly of said inlet to provide progressively reduced cross-sections in said channel, said inlet and cross-sections all being sufficiently large to accept nodules of desired size;

transporting said acceleration means along the surface of the sea bed for generating therein a generally horizontal and longitudinal progressively accelerating flow of water whose velocity exceeds the rate of transport of said apparatus over the sea bed;

mechanically lifting nodules from the sea bed and directing the nodules upwardly to a predetermined elevation into said flow rearwardly of said acceleration means inlet by contacting said nodules with transversely spaced elongated members extending upwardly and rearwardly in a region extending transversely of said flow across the lower portion of said channel, said elongated members moving between normally stationary working position and recoil position on encountering obstacles;

introducing said flow, nodules and at least a portion of any silt that may be associated with said nodules into duct means having an entry connected with said acceleration means and including confining means defining a path for nodules received from said lifting means and extending downstream of said lifting means, said confining means extending generally longitudinally above, below and to each side of said path, an inclined surface of said duct means having a generally horizontal transverse leading edge and downstream end, and extending upwardly and rearwardly relative to said leading edge, and silt discharge means comprising openings extending through said inclined surface;

continuing said flow along said duct means while discharging from the duct, through said openings, any silt dislodged from said nodules during said flow;

driving said nodules from said lifting means to the highest point of said inclined surface solely by means of the accelerated flow of water generated by the motion of said apparatus through the water;

establishing the flow of water in said duct and any silt which may be dispersed therein in a direction which will cause said flow to project upwardly and rearwardly downstream of said inclined surface;

introducing said nodules into a collection chamber through a zone downstream of said inclined surface having an increased cross-sectional area relative to the cross-sectional area of said duct measured at the downstream end of said inclined surface; and discharging said flow from the apparatus from an outlet whose cross-sectional area exceeds that of the duct, measured perpendicular to the direction of flow, at the downstream end of the inclined surface.

* * * * *

UNITED STATES PATENT AND TRADEMARK OFFICE

CERTIFICATE OF CORRECTION

PATENT NO. : 4,147,390

DATED : April 3, 1979

INVENTOR(S) : Jacques Deliege et al

It is certified that error appears in the above-identified patent and that said Letters Patent are hereby corrected as shown below:

Col. 1, line 18, cancel "said" and substitute --sand--;

Col. 6, line 8, cancel "lognitudinal" and substitute --longitudinal--;

Col. 7, lines 36 and 44, insert --of-- after "portion";

Col. 10, line 28, cancel "causing" and substitute --casing--;

Col. 11, line 24, cancel "slit" and substitute --silt--;

Col. 12, line 19, cancel "oposite" and substitute --opposite--;

Col. 12, line 24, figures "12" and "8" should be in a non-boldface type;

line 26, figure "1" should appear in non-boldface type;

Col. 13, line 22, cancel "a" between "with" and "jacks";

Col. 14, line 31, cancel "62" and substitute --63--;

Col. 14, line 32, cancel "thee" and substitute --the--;

Col. 14, line 61, cancel "Champer" and substitute --Chamber--

UNITED STATES PATENT AND TRADEMARK OFFICE

CERTIFICATE OF CORRECTION

PATENT NO. : 4,147,390 Page 2 of 2

DATED : April 3, 1979

INVENTOR(S) : Jacques Deliege et al

It is certified that error appears in the above-identified patent and that said Letters Patent are hereby corrected as shown below:

Col. 16, line 21, cancel "k" and substitute --K--;

Col. 17, line 17, cancel "5" and substitute --9--;

Col. 18, line 9, cancel "along side" and substitute --alongside--;

Col. 18, line 29, cancel "withe" and substitute --with--;

Column 21, line 40 cancel "shape" and substitute --shaped--;

Col. 23, line 38, figure "10" should appear in non-boldface type;

Col. 26, line 65, cancel "and" and substitute --said--;

Col. 29, line 28, cancel "coverging" and substitute --converging--.

Signed and Sealed this

Nineteenth Day of May 1981

[SEAL]

Attest:

RENE D. TEGTMEYER

Attesting Officer

Acting Commissioner of Patents and Trademarks